US011391515B2

(12) United States Patent
Reali et al.

(10) Patent No.: US 11,391,515 B2
(45) Date of Patent: Jul. 19, 2022

(54) CONVERTIBLE METALLURGICAL FURNACE AND MODULAR METALLURGICAL PLANT COMPRISING SAID FURNACE FOR CONDUCTING PRODUCTION PROCESSES FOR THE PRODUCTION OF METALS IN THE MOLTEN STATE, IN PARTICULAR STEEL OR CAST IRON

(71) Applicants: TENOVA S.P.A., Milan (IT); TENOVA INDUSTRIAL TECHNOLOGIES (BEIJING) CO., LTD, Beijing (CN)

(72) Inventors: Silvio Maria Reali, Milan (IT); Cesare Giavani, Milan (IT); Giuseppino Virgili, San Fermo Della Battaglia (IT); Cristian Cattalini, Milan (IT)

(73) Assignees: TENOVA S.P.A., Milan (IT); TENOVA INDUSTRIAL TECHNOLOGIES (BEIJING) CO., LTD., Beijing (CN)

( * ) Notice: Subject to any disclaimer, the term of this patent is extended or adjusted under 35 U.S.C. 154(b) by 403 days.

(21) Appl. No.: 16/465,626

(22) PCT Filed: Dec. 2, 2016

(86) PCT No.: PCT/CN2016/108420
§ 371 (c)(1),
(2) Date: May 31, 2019

(87) PCT Pub. No.: WO2018/098817
PCT Pub. Date: Jun. 7, 2018

(65) Prior Publication Data

US 2020/0018550 A1 Jan. 16, 2020

(51) Int. Cl.
*F27D 1/00* (2006.01)
*F27D 1/02* (2006.01)
(Continued)

(52) U.S. Cl.
CPC ..... *F27D 11/10* (2013.01); *C21B 11/10* (2013.01); *C21C 5/527* (2013.01); *C21C 5/5217* (2013.01);
(Continued)

(58) Field of Classification Search
CPC .. F27B 14/02; F27B 14/06; F27B 3/04; F27B 3/045; F27B 3/065; F27B 3/085;
(Continued)

(56) References Cited

U.S. PATENT DOCUMENTS 3,812,275 A 5/1974 Schempp
3,864,122 A 2/1975 Seelig et al.
(Continued)

FOREIGN PATENT DOCUMENTS

CN 1131698 A 9/1996
CN 2514003 Y 10/2002
(Continued)

OTHER PUBLICATIONS

Extended European Search Report dated Apr. 3, 2020 re: Application No. PCT/CN2016/108420, pp. 1-7, JP H08 233466 A, US 3 905 589 A.
(Continued)

*Primary Examiner* — Hung D Nguyen
(74) *Attorney, Agent, or Firm* — Cantor Colburn LLP

(57) ABSTRACT

A metallurgical furnace including a vessel with a lower shell for containing a metal bath, the metal bath composed of molten metal and an overlying layer of slag. The lower shell is tiltingly supported and provided with a deslagging opening for evacuating the slag and a tapping opening for tapping the molten metal. The vessel includes an upper shell removably positioned on the lower shell and first and second inlet openings for feeding. The vessel includes a closing roof for the upper closing of the vessel removably positioned on the
(Continued)

upper shell and a passage opening for the passage, through the same, of at least one electrode, at least one charge opening for feeding, through the same, charge material in the solid state. At least one of the inlet openings, passage opening, and charge opening is closed or associated with a closing element.

19 Claims, 12 Drawing Sheets

(51) Int. Cl.

| | |
|---|---|
| ***F27D 3/00*** | (2006.01) |
| ***F27D 11/10*** | (2006.01) |
| ***C21B 11/10*** | (2006.01) |
| ***C21C 5/52*** | (2006.01) |
| ***C21C 5/54*** | (2006.01) |
| ***F27B 14/02*** | (2006.01) |
| ***F27B 14/06*** | (2006.01) |
| ***F27D 3/14*** | (2006.01) |
| ***F27D 3/15*** | (2006.01) |
| ***H05B 7/144*** | (2006.01) |
| ***H05B 7/20*** | (2006.01) |

(52) U.S. Cl.
CPC ..... *C21C 5/54* (2013.01); *F27B 14/02* (2013.01); *F27B 14/06* (2013.01); *F27D 1/025* (2013.01); *F27D 3/0025* (2013.01); *F27D 3/14* (2013.01); *F27D 3/1554* (2013.01); *H05B 7/144* (2013.01); *H05B 7/20* (2013.01)

(58) Field of Classification Search
CPC ..... F27B 3/10; F27B 3/12; F27B 3/16; F27B 3/18; F27B 3/183; F27B 3/186; F27B 3/19; F27B 3/24; H05B 7/07; H05B 7/11; H05B 7/144; H05B 7/20; C21B 11/10; F27D 11/08; F27D 11/10; F27D 1/025; F27D 1/12; F27D 1/1816; F27D 3/0024; F27D 3/0025; F27D 3/0027; F27D 3/0028; F27D 3/0032; F27D 3/0033; F27D 3/04; F27D 3/10; F27D 3/14; F27D 3/1509; F27D 3/1536; F27D 3/1554; C21C 5/285; C21C 5/42; C21C 5/46; C21C 5/50; C21C 5/52; C21C 5/5211; C21C 5/5217; C21C 5/5229; C21C 5/527; C21C 5/5264; C21C 5/54; C21C 5/562; C21C 5/565
USPC ..... 373/60, 73, 78–84, 71–72
See application file for complete search history.

(56) References Cited

U.S. PATENT DOCUMENTS

| | | | | |
|---|---|---|---|---|
| 3,905,589 | A | 9/1975 | Schempp et al. | |
| 4,210,023 | A | 7/1980 | Sakamoto | |
| 4,473,397 | A | 9/1984 | Bleeck | |
| 4,543,124 | A | 9/1985 | Vallomy | |
| 5,028,258 | A | 7/1991 | Aberl | |
| 5,393,037 | A | 2/1995 | Ehle | |
| 5,584,909 | A | 12/1996 | Kim | |
| 5,588,982 | A | 12/1996 | Hendrix | |
| 5,602,867 | A | 2/1997 | Hubers | |
| 5,800,591 | A | 9/1998 | Vallomy | |
| 2002/0071473 | A1* | 6/2002 | Stercho | F27B 3/10 373/78 |
| 2010/0180723 | A1* | 7/2010 | Fujimoto | C21B 13/004 75/10.61 |

FOREIGN PATENT DOCUMENTS

| | | | |
|---|---|---|---|
| CN | 1775959 | A | 5/2006 |
| CN | 102634637 | A | 8/2012 |
| EP | 1566455 | A1 | 8/2005 |
| EP | 3317602 | B1 | 5/2019 |
| EP | 3280824 | B1 | 6/2019 |
| JP | H08233466 | A | 9/1996 |
| JP | 2895247 | B2 | 5/1999 |
| RU | 2102494 | C1 | 1/1998 |
| RU | 2192475 | C2 | 11/2002 |
| UA | 63969 | C2 | 2/2004 |
| WO | 2007109875 | A1 | 10/2007 |
| WO | 2014012623 | A1 | 1/2014 |

OTHER PUBLICATIONS

International Search Report for corresponding application PCT/CN2016/108420 filed Dec. 2, 2016; dated Aug. 10, 2017.
Written Opinion of the International Searching Authority for corresponding application PCT/CN2016/108420 filed Dec. 2, 2016; dated Aug. 10, 2017.
CN Office Action dated Jul. 15, 2020 re: Application No. 2016800919773.8, pp. 1-20, citing: CN1131698A, US3812275A, US5393037A, JPH08233466A, US3905589A and CN2514003Y.
Shen Caifang et al., "Chapter 2 Mechanical Equipment of Electric Arc Furnaces", Electric Arc Furnace Steelmaking Process and Equipment, Jul. 8, 2020; pp. 1-20; Version 2; http://img.sslibrary.com/n/print.jsp.
RU office action dated Feb. 14, 2020 re: Application No. 2019118740/02, pp. 1-23, citing: US5602867 A, US 3864122 A, RU 2102494 C1, RU 2192475 C2 and UA 63969 A.
Cesare Giavani, "FMF Base Module": No Electric Power Steelmaking with "FMF Base Module": Presented during the 6th International Congress on the Science & Technology of Steelmaking held in China on May 12-14, 2015; Organized by the Chinese Society of Metals.
Scrap vs. Hot Metal, IBOF and Flexible Modular Furnace: Tenova Answers to Flexible Technologies Demand. Presented during the 8th China International Congress held in China on May 19-20, 2014 and organized by China Iron and Steel Association.
CN Office Action dated Aug. 25, 2021 re: Application No. 201680091973.8, pp. 1-29, citing: Shen Caifang et al. "Mechanical Equipment . . . ", JPH08233466A and Zhu Miao-Yong, "Modem Metallurgical Technology . . . "
Zhu Miao-Yong "Modern Metallurgical Technology Steel Metallurgy", Metallurgical Industry Press, Jun. 30, 2011, pp. 229-230.

* cited by examiner

CONVERTIBLE METALLURGICAL FURNACE AND MODULAR METALLURGICAL PLANT COMPRISING SAID FURNACE FOR CONDUCTING PRODUCTION PROCESSES FOR THE PRODUCTION OF METALS IN THE MOLTEN STATE, IN PARTICULAR STEEL OR CAST IRON

The present invention relates to a metallurgical furnace of the type that can be converted into an electric arc furnace or converter for conducting production processes for producing metals in the molten state, in particular steel or cast iron.

The present invention also relates to a modular metallurgical plant comprising said metallurgical furnace of the convertible type for conducting production processes for producing metals in the molten state, in particular steel or cast iron.

With particular reference to the production of steel, production processes of molten steel of the known type can be divided into two main types depending on the raw material used:

So-called "Integral Cycle" Production Process or "Blast Furnace Steelmaking",

So-called "Scrap Cycle" Production Process or "Electric Arc Furnace Steelmaking".

The so-called "Integral Cycle" production process uses cast iron in the molten state tapped from a blast furnace, as main raw material. The molten cast iron is transformed into steel due to oxidation of the Carbon contained therein. This process is carried out inside a converter also known with the abbreviation BOF (Basic Oxygen Furnace), into which the cast iron in the molten state is charged batchwise and the oxygen necessary for the oxidation of the carbon is fed through an injection lance.

As is known, this process is strongly exothermic and does not require further external energy supplies; on the contrary, controlled quantities of scrap DRI (Direct Reduced Iron), HBI (Hot Briquetted Iron) and iron minerals as cooling agents of the metal bath, are sometimes added to the cast iron in the molten state.

One of the problems that arise in conducting this type of production process consists in so-called "slopping", i.e. an overflow of the material from the mouth of the converter. This overflow is due to the development of particularly violent reactions that are generated when the production of CO is at maximum levels and causes an uncontrolled foaming of the slag, also generating oscillating movements of the metal bath.

Numerous attempts have been made for controlling and limiting slopping.

As described in U.S. Pat. Nos. 4,210,023, 5,028,258 or 5,584,909, for example, the monitoring of a process parameter is proposed (such as, for example, the height of the slag, sounds that develop in the converter or the production of CO), whose values can be indicative of the onset of the slopping phenomenon, consequently modifying the oxygen supply, reducing its flow-rate and/or lowering its injection point and/or introducing calcium-based cooling agents.

These methods, however, are inevitably affected by errors of the monitoring system adopted, and unacceptably slow down the production process. Both the monitoring system used, and the oxygen injection lance, moreover, are subject to damage and breakage and require frequent maintenance and substitution interventions.

Adding additives to the molten bath, capable of modifying the rheological properties of the slag, in particular decreasing its viscosity, has also been proposed for mitigating the slopping phenomenon, as described, for example, in U.S. Pat. No. 4,473,397. This method, however, has high costs due to the use of additives, such as, for example, calcium carbide.

The slopping phenomenon therefore remains one of the main problems in conducting "integral cycle" steel production processes.

The so-called "scrap cycle" production process, on the other hand, uses, as main raw material, materials prevalently or totally in the solid state consisting of scrap possibly mixed with pig iron, DRI (Direct Reduced Iron), HDRI (Hot Direct Reduced Iron), HBI (Hot Briquetted Iron), iron minerals and additives of the known type.

These materials are fed, batchwise and/or in continuous, and possibly preheated (such as, for example, the known Consteel® system), into known electric arc furnaces (EAF) where they are melted thanks to the contribution of thermal energy supplied from electric arcs.

The structure, equipment and functioning of a converter (BOF) and those of an electric arc furnace (EAF), as also those of the relative steelmaking plants, are extremely different from each other. These differences are such, in fact, that, due to variations in the availability, in quantitative and/or economic terms, of the raw materials that can be used, it is impossible to use cast iron as a feed material of a traditional EAF in percentages close to 100%, or scrap as feed material of a traditional BOF in percentages close to 100%.

In some countries, such as China for example, steelmaking plants for the "scrap cycle" production of steel have long been installed, whose furnaces are therefore to all effects electric arc furnaces. Due to the shortage of scrap and availability of electric energy that have occurred over the years, these plants have been used by substituting the scrap with liquid cast iron in such quantities as to render the supply of electric energy unnecessary, adopting production processes as described, for example, in CN102634637 or in CN100363508. The furnace of these plants is structured and equipped from the outset as an electric arc furnace, in which, as it is known, lances for the injection of oxygen, coal and other materials are already present. For conducting steel production processes starting from raw materials prevalently consisting of liquid cast iron, these lances have been enhanced for meeting the increased requirement for reagents necessary for the transformation reactions of liquid cast iron into steel, substantially keeping the structure and configuration of the furnace unchanged.

In these plants so diversely used, in which the EAF is fed with a charge prevalently consisting of liquid cast iron to such an extent as to make the electric energy supply unnecessary, the problem relating to slopping or splashing, i.e. the projection of molten material onto the roof of the furnace or onto the fume suction connection, and solidification of this material with the forming of deposits (jamming), has remained unsolved.

An object of the present invention is to provide a metallurgical furnace whose structure and configuration are suitable and easily adaptable for conducting production processes for the production of metals in the molten state, in particular steel or cast iron, starting from any raw material or mixture of raw materials available, preferably, but not necessarily, fed in continuous.

A further object of the present invention is to provide a metallurgical furnace in which production processes for the production of metals in the molten state, in particular steel or cast iron, starting from any raw material or mixture of raw materials available, preferably, but not necessarily, fed in continuous, can be conducted, reducing known "slopping", "splashing" and "jamming" phenomena, and at the same time guaranteeing a good mixing of the metal bath in any operative condition.

Another object of the present invention is to provide a modular metallurgical plant that can be easily adapted to conducting production processes for the production of molten metals, in particular steel or cast iron, starting from any raw material or mixture of raw materials available, preferably, but not necessarily, fed in continuous.

Yet another object of the present invention is to provide a modular metallurgical plant that is structurally and functionally flexible for being easily adapted, with a limited number of interventions, to conducting production processes for the production of molten metals, in particular steel or cast iron, starting from any raw material or mixture of raw materials available, preferably, but not necessarily, fed in continuous.

These objects according to the present invention are achieved by producing a metallurgical furnace of the type that can be converted into an electric arc furnace or converter for conducting production processes for the production of metals in the molten state, in particular steel or cast iron, as outlined in claim 1.

These objects according to the present invention are also achieved by producing a modular metallurgical plant for conducting production processes for the production of molten metal, in particular steel or cast iron, as outlined in claim 11.

Further characteristics are provided in the dependent claims.

The characteristics and advantages of a furnace and metallurgical plant according to the present invention will appear more evident from the following illustrative and non-limiting description, referring to the enclosed schematic drawings, in which.

Figure 7:
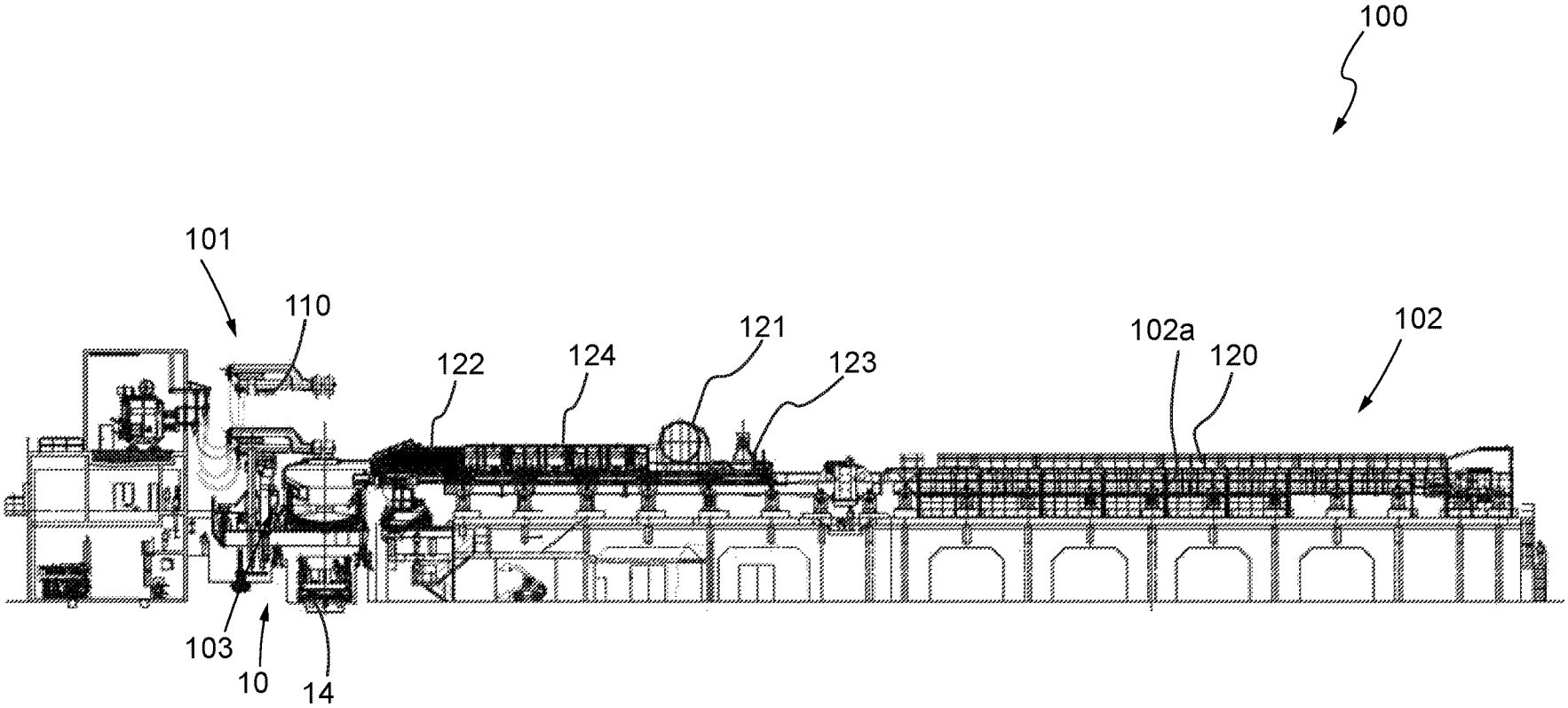
Figure 7A:
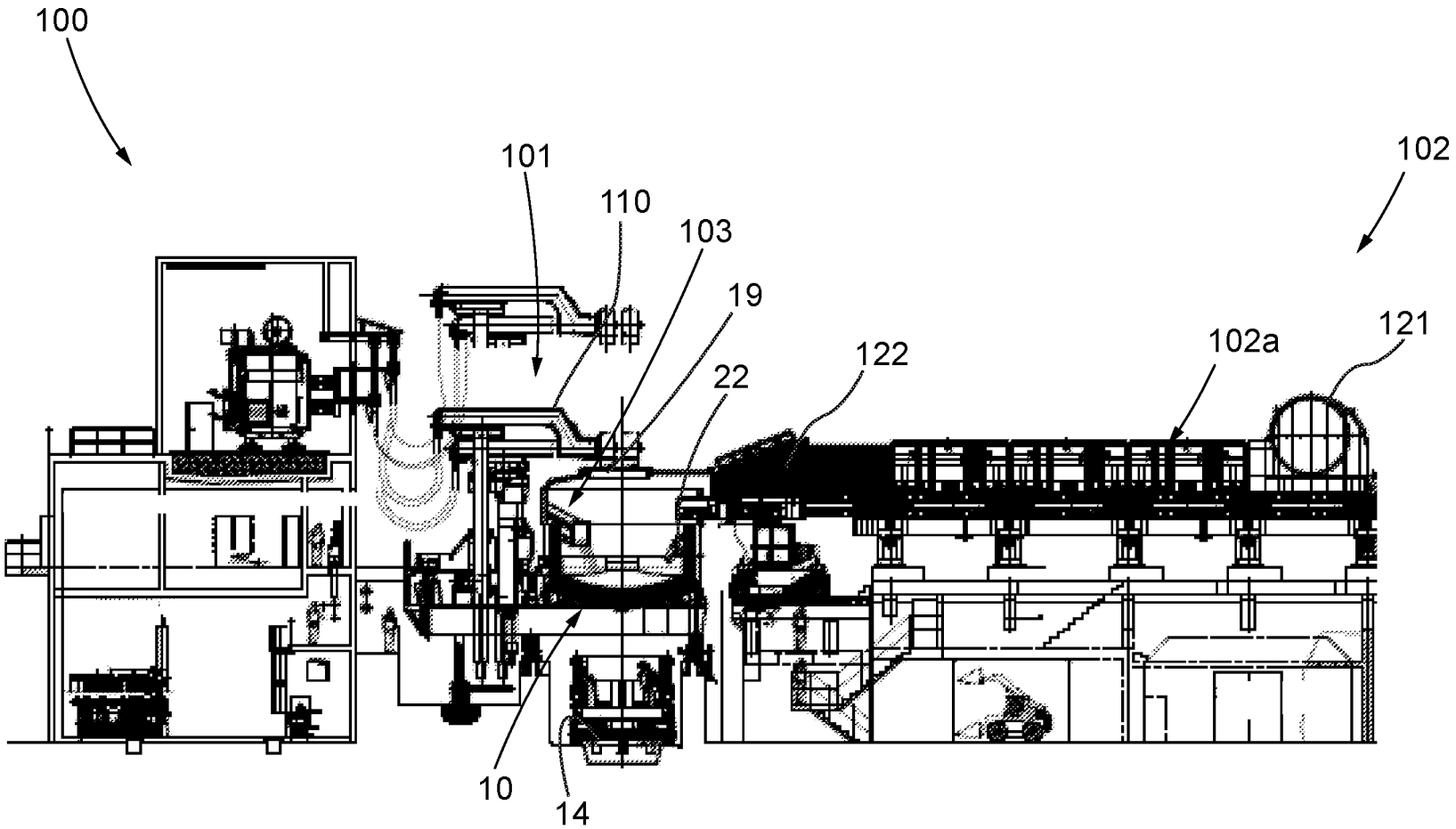
Figure 8:
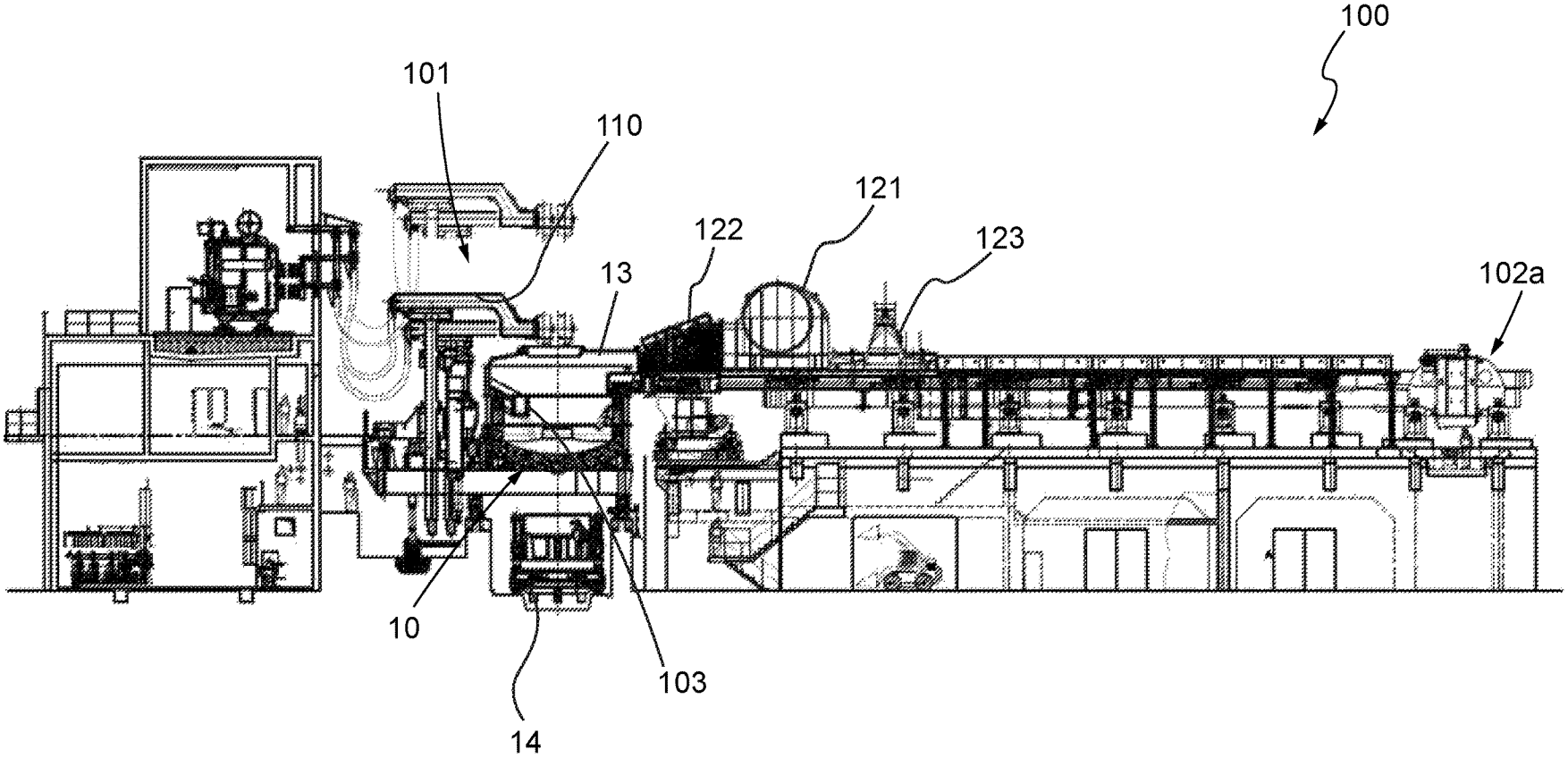
Figure 8A:
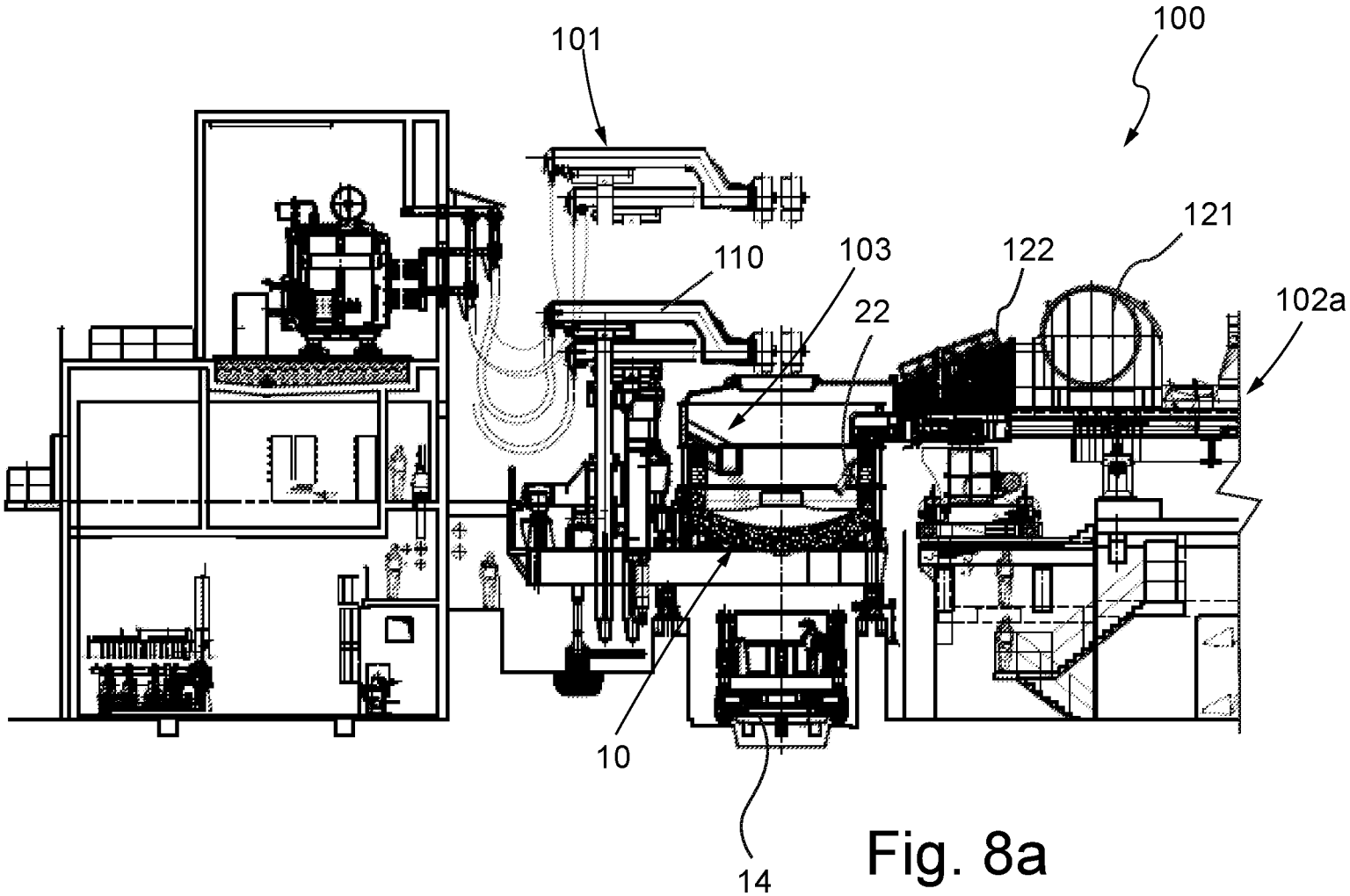
Figure 9:
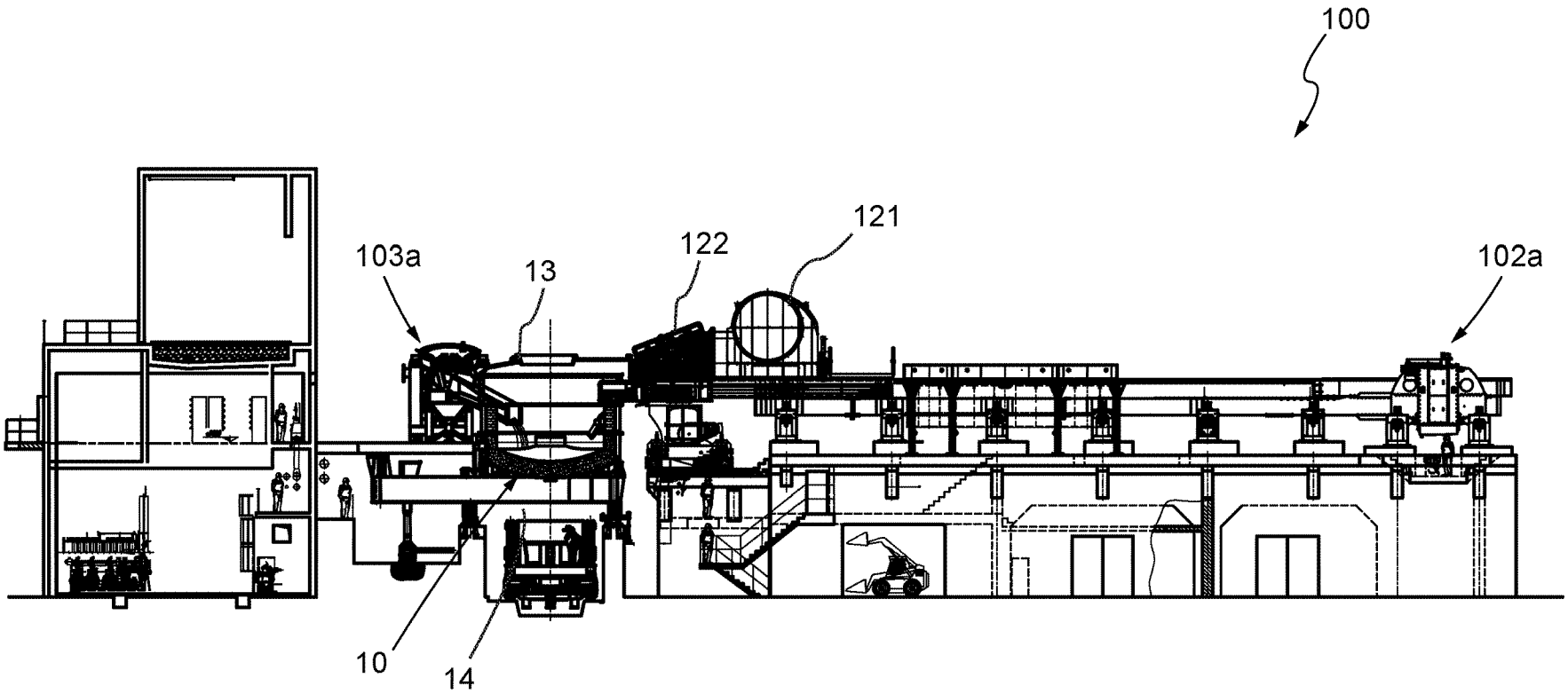
Figure 9A:
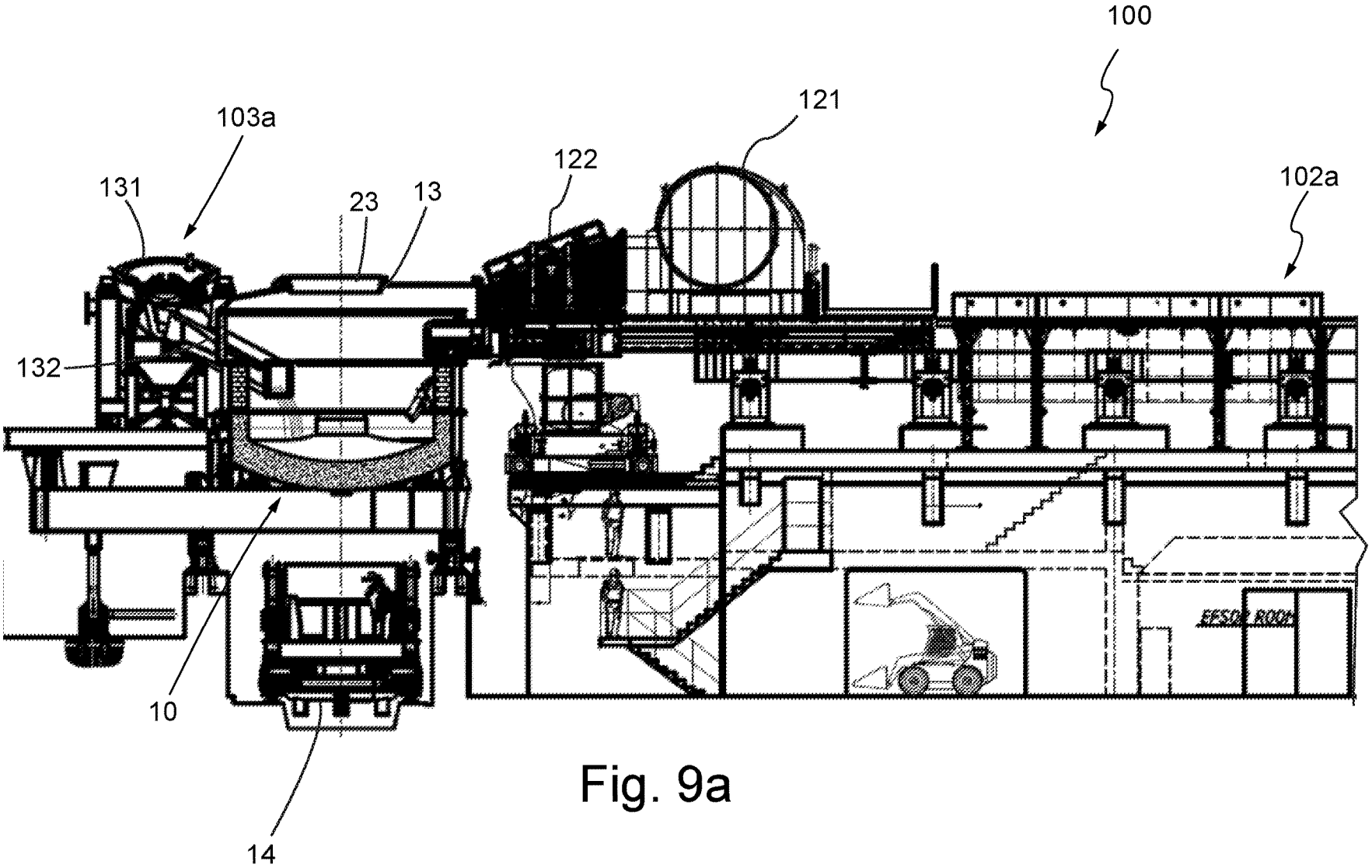

FIGS. 7, 8 and 9 schematically show various possible configurations of a metallurgical plant for the production of steel according to the present invention with a variation in the type of charge material respectively consisting of about 90% of scrap and 10% of liquid cast iron (FIG. 7), 50% of scrap and 50% of liquid cast iron (FIG. 8) and 10% of scrap and 90% of liquid cast iron;

FIGS. 7A, 8A and 9A are views on an enlarged scale of a detail of FIGS. 7, 8 and 9 respectively.

With reference to the figures, these show a metallurgical furnace 10 of the type that can be converted into an electric arc furnace or into a converter for conducting production processes for the production of metals in the molten state, in particular steel or cast iron.

As specified hereunder, the furnace 10 is suitable for conducting production processes, in particular for the production of steel or cast iron, starting from any mixture of charge materials in the solid state and/or charger materials in the liquid state.

Charge materials in the solid state refer, in particular, to scrap, pig iron, HBI (Hot Briquetted Iron), DRI (Direct Reduced Iron), HDRI (Hot Direct Reduced Iron).

Charge materials in the liquid state refer, in particular, to molten cast iron (liquid cast iron).

Process raw materials such as oxygen, pulverized coal, lime, dolo lime, alloying materials and others known to skilled persons in the field, are added to said charge materials, alone or mixed with each other.

The furnace 10, in particular, preferably has a continuous functioning and is installed in a production plant 100 of steel or cast iron in which the charge materials, whether they be in the solid or liquid state, alone or mixed with each other, are preferably, but not necessarily, fed in a continuous and controlled manner.

The furnace 10 comprises:

a vessel in turn comprising:

a lower shell 11 for containing the metal bath, wherein the metal bath formed during the production process is composed of molten metal and an overlying layer of slag, and a upper shell 12 removably positioned on the lower shell 11, a closing roof 13 for the upper closing of the vessel and which is removably positioned above the upper shell 12.

The lower shell 11 is advantageously, but not necessarily, internally coated with a refractory material so as to be able to contain the molten metal bath.

The lower shell 11 is tiltingly supported around a horizontal tilting axis by means of a tilting mechanism 14 configured for allowing a tilt with respect to the vertical plane of −12° (for carrying out deslagging operations) and +20° (for carrying out casting operations), against tilts of −10° and +15° respectively typical of an EAF of the known type.

The lower shell 11 is provided with a deslagging opening 15 for evacuating the slag overlying the molten metal.

The deslagging opening 15 is of the closable type and communicates with a deslagging channel of the known type.

Figure 1:
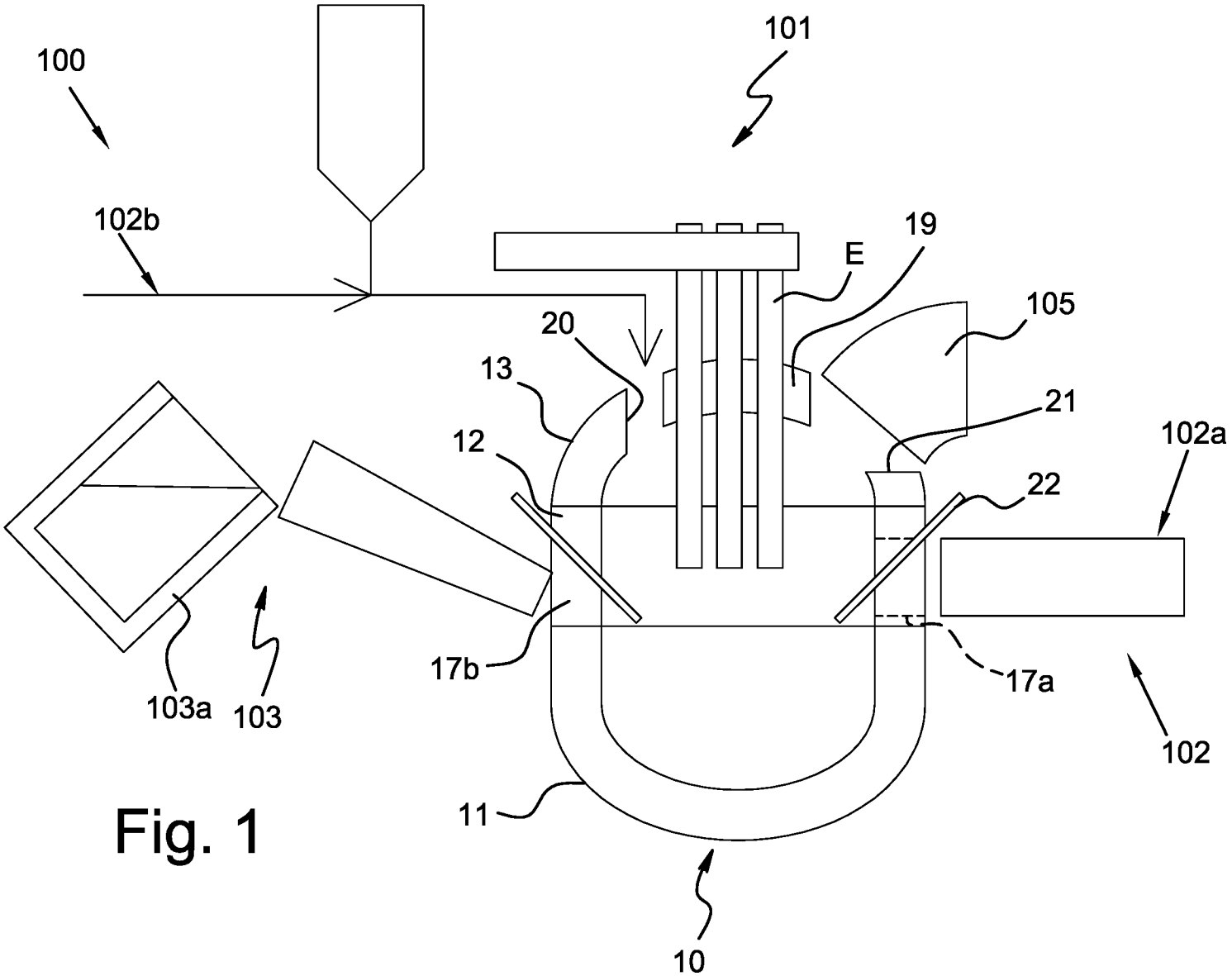
FIG. 1 is a scheme of a metallurgical plant according to the present invention for the production of steel or cast iron.
Figure 2:
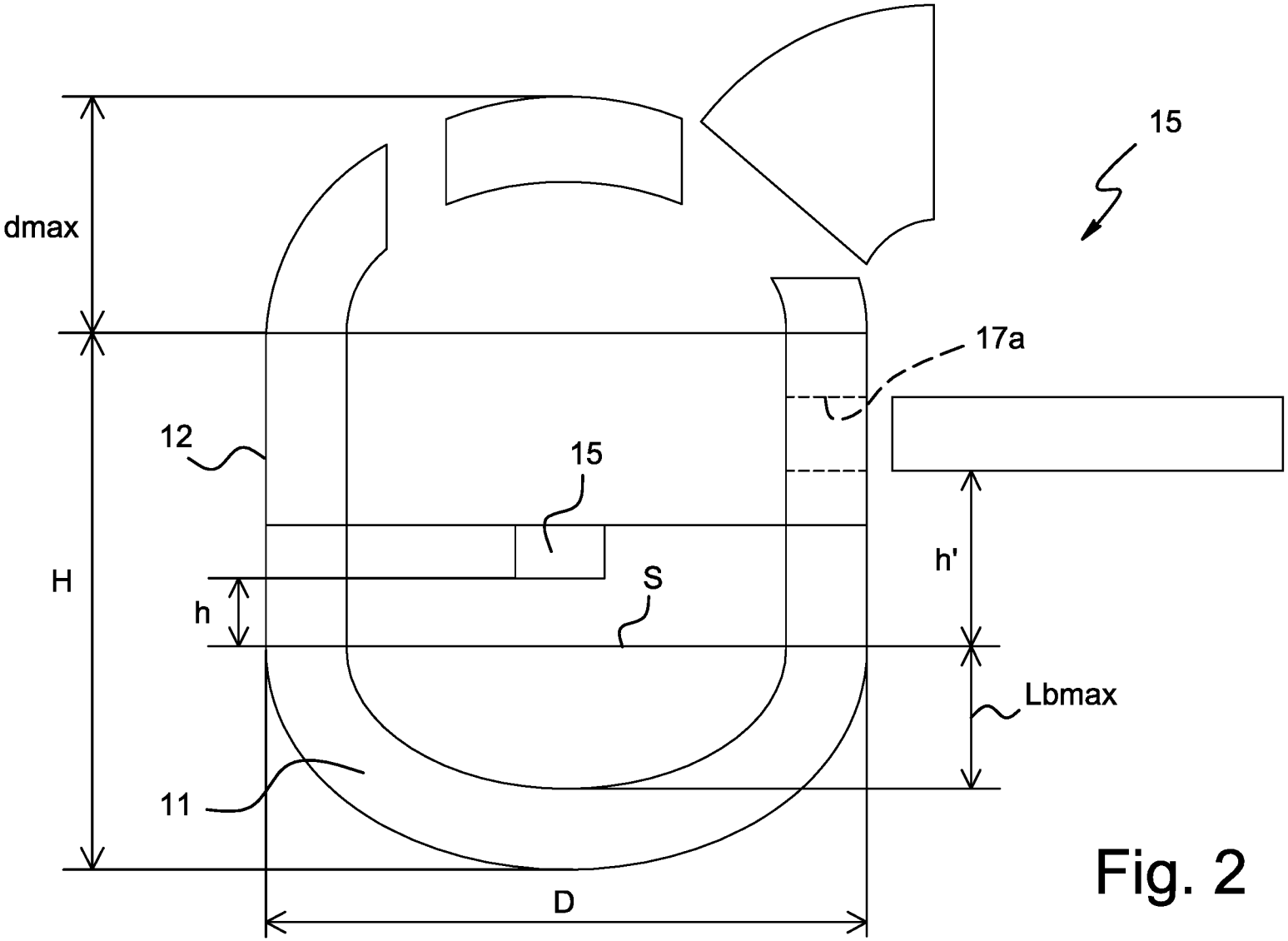
FIG. 2 is a scheme of the metallurgical furnace according to the present invention for the production of steel or cast iron.
Figure 3:
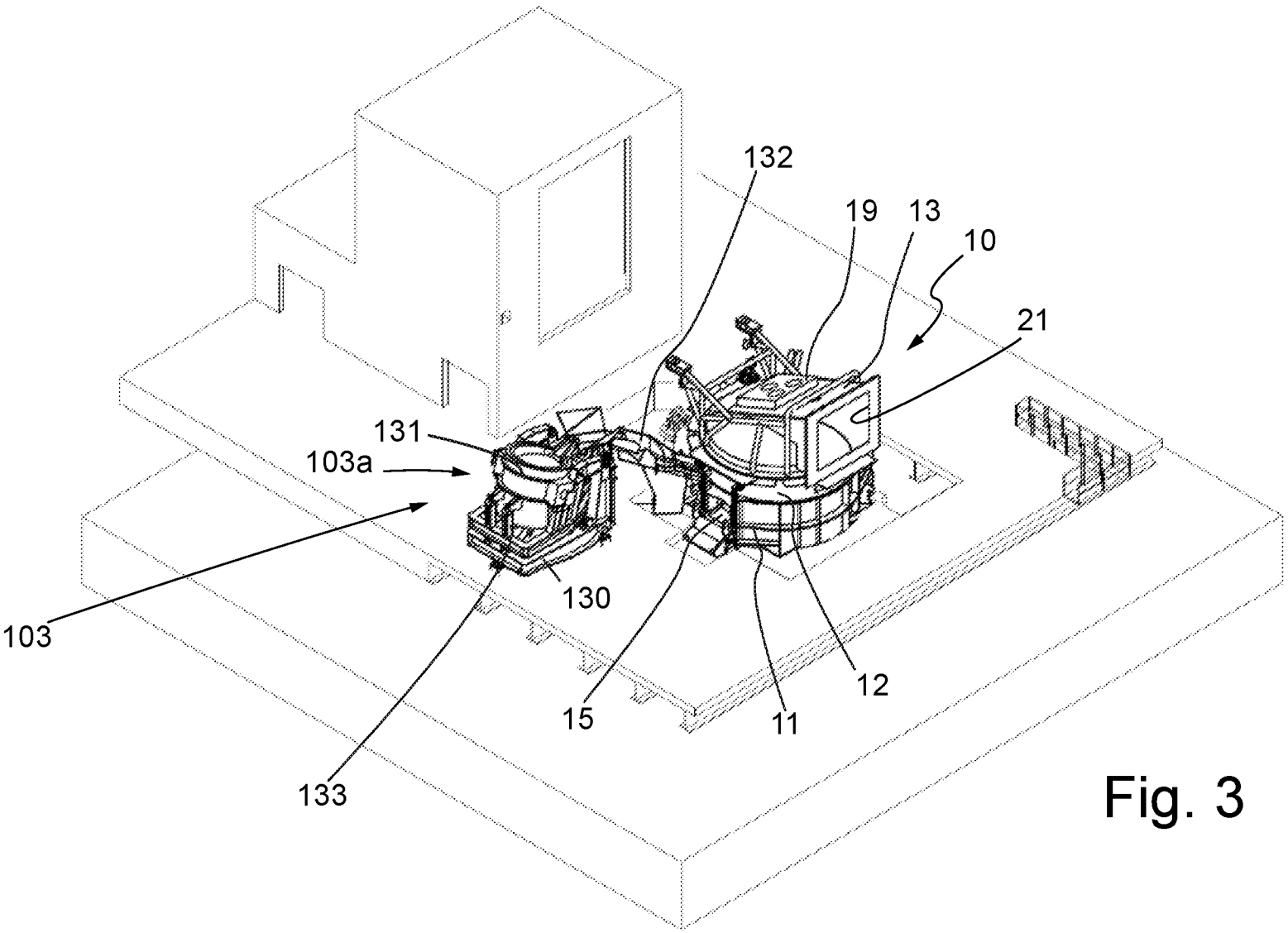
FIG. 3 is an axonometric view of a possible embodiment of a metallurgical furnace according to the present invention for the production of steel coupled with a feeding group for the continuous supply of material in the molten state.
Figure 4:
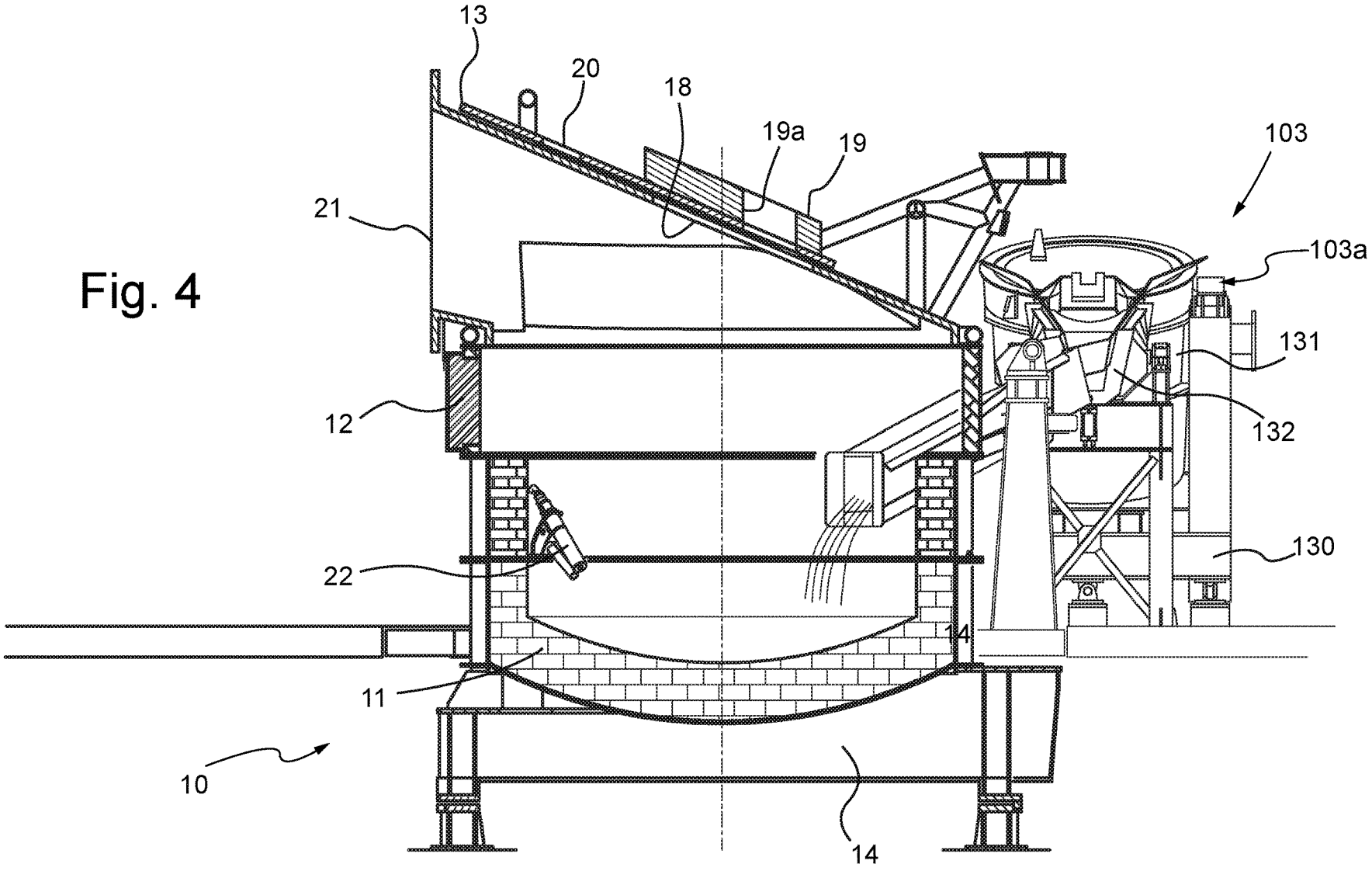
FIGS. 4 and 5 are schematic sections according to two vertical planes orthogonal to one another of FIG. 3.
Figure 5:
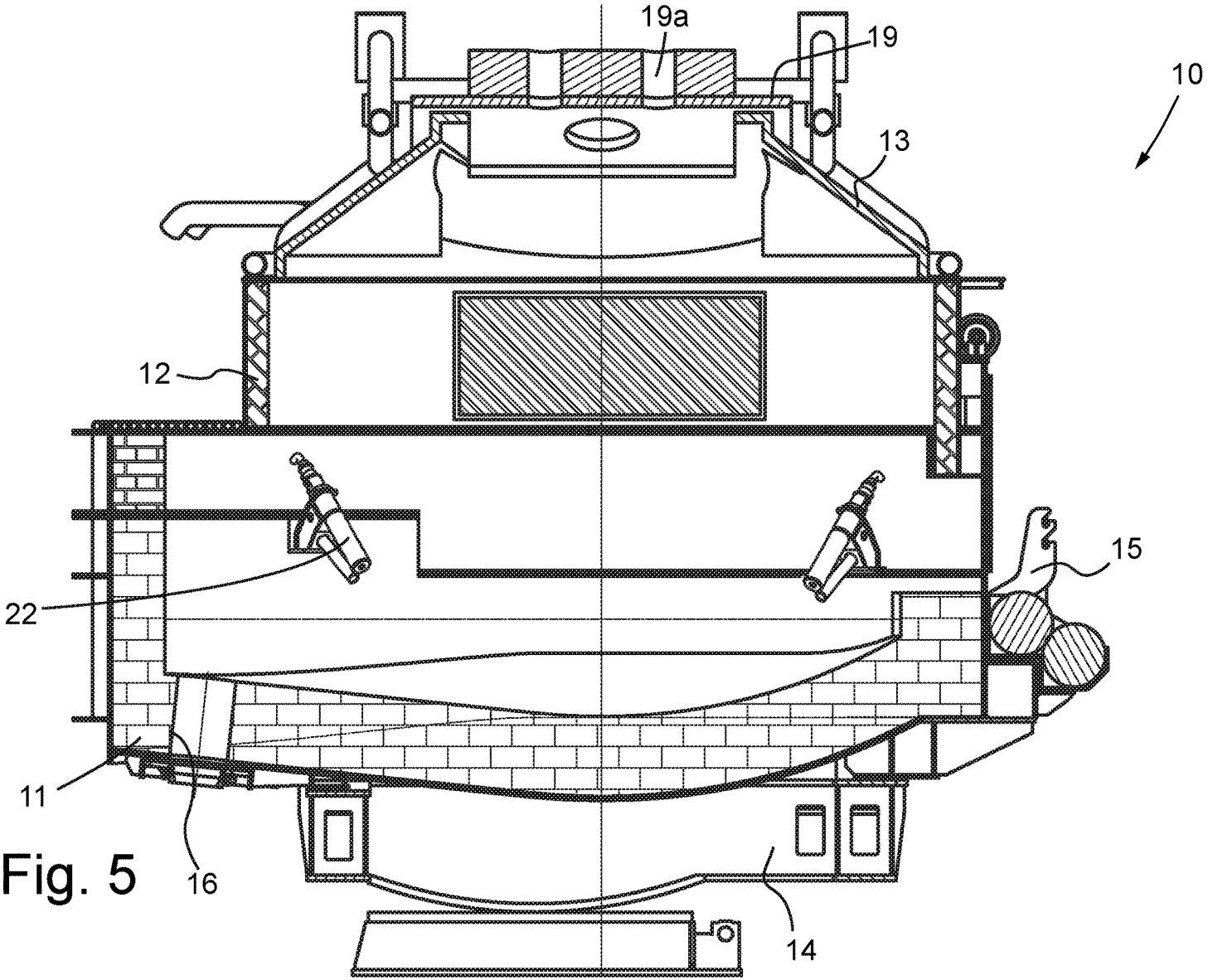
Figure 6:
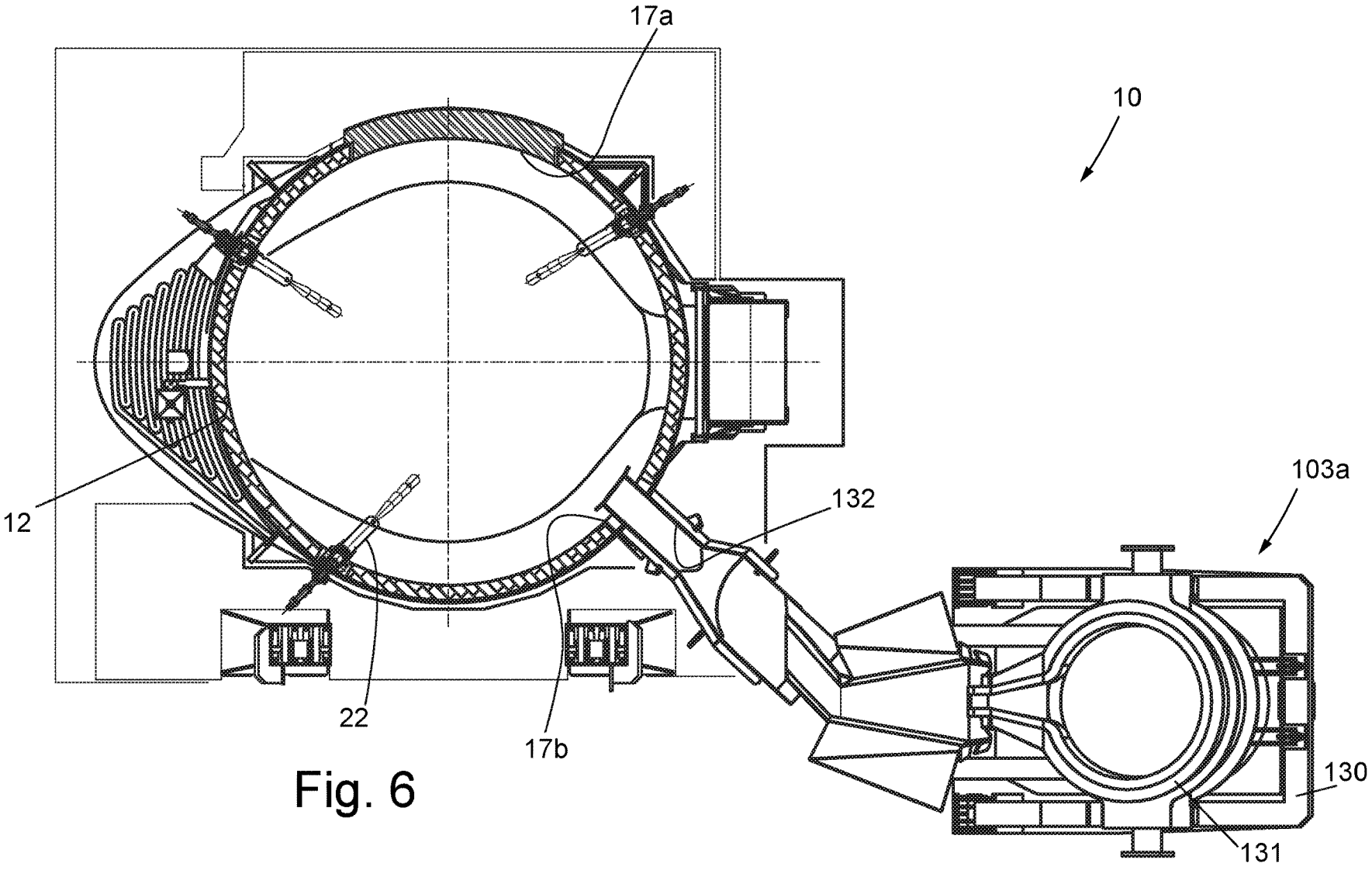
FIG. 6 is a schematic section according to a horizontal plane of FIG. 3.

The lower shell 11 is also provided with a tapping opening 16 for tapping or casting the molten metal (not represented in FIGS. 1 and 2). The tapping opening 16 can consist, in the known manner, of a casting hole of the reclosable type which is situated in the bottom of the lower shell 11 in an eccentric position (known as EBT: Eccentric Bottom Tapping), or it can consist of a free beak or siphon system.

During the steel production process, both the deslagging opening 15 and the tapping opening 16 can advantageously be substantially hermetically closed to prevent the entry of atmospheric air into the furnace 10 and the exit of gases from the furnace 10, generated in its inside. This is advantageously the case when the charge material totally or prevalently consists of cast iron in the molten state (liquid cast iron) and the furnace 10 is used in converter mode; in this case, in fact, in some of the implementation phases of the production processes, gases rich in carbon monoxide (CO) are generated, that can be recovered and re-used also inside the same steelworks as fuel, for example.

The upper shell 12 is removably positioned above the lower shell 11 and is provided with at least one inlet opening 17*a*, 17*b* for feeding charge material in the solid or molten state through the same.

In a preferred embodiment, the upper shell 12 comprises:

- a first inlet opening 17*a* for feeding charge material in the solid state through the same, which can be associated with a first feeding group 102*a* for the continuous feeding of said charge material in the solid state and/or
- a second inlet opening 17*b* for feeding charge material in the molten state through the same, which can be associated with a first feeding group 103*a* for the continuous feeding of said charge material in the molten state.

The upper shell 12 preferably comprises both the first inlet opening 17*a* and the second inlet opening 17*b*.

Also in this case, as mentioned above, during the steel production process, the inlet opening(s) 17*a*, 17*b* positioned in the upper shell 12, can advantageously be substantially hermetically closed to prevent the entry of atmospheric air into the furnace 10 and the exit of gases from the furnace 10, generated in its inside. This is advantageously the case when the charge material totally or prevalently consists of cast iron in the molten state (liquid cast iron) and the furnace 10 is used in converter mode; in this case, in fact, in some of the implementation phases of the production processes, gases rich in carbon monoxide (CO) are generated, that can be recovered and re-used also inside the same steelworks as fuel, for example.

The roof 13 is provided with a passage opening 18 for the passage through the same of at least one electrode. The passage opening 18 is generally removably obtained in the central portion of the roof and can be coupled with a removable completion element 19, also called "delta", in which at least one pass-through hole 19*a* is obtained for the passage of a corresponding electrode E such as a graphite electrode, as described hereunder. The roof "delta" 19 is coupled with the roof 13 if the furnace 10 is to be supplied with electric energy by means of one or more electrodes E.

The roof 13 can also comprise at least one charge opening 20 for feeding charge material in the solid state through the same, and/or at least one evacuation opening 21 for discharging the gas fumes generated inside the furnace 10 during the production process.

At least one of the inlet opening(s) 17*a*, 17*b*, passage opening 18, charge opening 20 and evacuation opening 21, when provided, is associated with a respective closing element of the removable type or, alternatively, can be removably sealed depending on the configuration of use of the furnace 10, as described hereunder.

The upper shell 12 can be of the cooled type, i.e. consisting of panels in which circuits are obtained through which cooling fluids circulate or radiators.

Alternatively, the upper shell 12 can be internally coated with a refractory material and possibly cooled by air or by means of radiators, or it can be completely made of refractory material.

As described hereunder, the furnace 10 is equipped with a group of injectors 22 for the injection of oxygen, methane, pulverized coal, lime or other raw materials suitable for conducting the production process; in a preferred embodiment, the injectors 22 are inserted in the upper shell 12.

The furnace 10 is dimensioned so as to be able to be easily adapted to various configurations of use in relation to the type of raw materials available and the availability of electric energy, to enable it to be used as an electric arc furnace or as a converter, in both cases guaranteeing a good mixing of the metal bath and a reduction in bubbling phenomena and jets of slag and/or molten metal.

More specifically, D being the diameter of the lower shell 11 and H the overall height of the vessel, measured from the bottom of the lower shell 11 as far as the upper end of the upper shell 12, said H ranges from 0.70 D to 1.25 D.

The height H preferably ranges from 0.70 D to 0.80 D when the furnace 10 is used as an electric arc furnace and from 0.80 D to 1.25 D when the furnace 10 is used as a converter.

The variation in height H is obtained by substituting the upper shell 12 with another having a suitable height, with the same lower shell 11.

It should be pointed out that the diameter D is the maximum external diameter of the lower shell 11 and the height H is the overall external height of the both the lower shell 11 and upper shell 12.

The diameter D is determined, in the known way, in relation to the type of raw materials available and mixture of the same used as charge material, the productivity and decarburization rate required.

Furthermore, S being the extension in $m^2$ of the free surface of the metal bath, it meets the condition according to which R being the ratio between the flow-rate of carbon monoxide ($P_{CO}$ in $m^3$CO/min) generated during the decarburization of the metal bath for the production of steel or cast iron and the extension S, said ratio R(=$P_{CO}$/S) is ≥16 ([$m^3{}_{CO}$/min$_{[/[}$$m^2{}_{]}$]), against maximum values of R equal to 12 typical of the known electric arc furnaces. This guarantees a greater productivity in terms of decarburization of the metal bath, in particular if the furnace 10 is used in the converter mode.

It should be pointed out that the extension S of the free surface of the metal bath is measured above the concave bottom of the lower shell 11 in correspondence with the cylindrical portion of the shell having a substantially constant transversal section.

The height of the metal bath Lb contained in the lower shell 11 varies from a minimum value, which depends on the penetration degree of the oxygen injected by the injectors 22 into the metal bath, and a maximum value, which on the one hand must keep the metal bath being formed homogeneous, avoiding stratification phenomena of the same, and on the other hand must guarantee that the deslagging operations are effected when the furnace 10 is used in the converter mode.

Lbmax being the maximum level (i.e. maximum height) that can be reached by the metal bath in the lower shell 11, the vertical distance h between Lbmax and the lower edge of the deslagging opening 15 ranges from 0.055 D to 0.077 D. This allows a better containment of the metal bath, particularly when the furnace 10 is used in the converter mode, when the slag is subject to bubbling phenomena, at times intense.

In practice, the deslagging opening 15 (or better the lower edge of the same) is at a greater height h with respect to the maximum level of the metal bath Lbmax than in electric arc furnaces of the known type so as to prevent possible leakages of material during the production processes, in particular in the converter mode.

In an electric arc furnace of the known type, for example, h typically ranges from 250 mm to 350 mm, whereas in the furnace according to the present invention, h ranges from 350 mm to 500 mm.

Furthermore, the vertical distance h' between the maximum level (maximum height) Lbmax that can be reached by the metal bath contained in the lower shell 11 and the lower edge of the inlet opening 17*a* obtained in the upper shell 12 for the entry of charge material in the solid state, ranges from 1.6 m to 2.2 m, (h'=1.6 m-2.2 m).

Also in this case, the inlet opening 17*a* (the lower edge of the same) is basically at a greater height with respect to the maximum level of the metal bath Lbmax than in electric arc furnaces of the known type so as to prevent possible leakages of material during the production processes, in particular in the converter mode.

In an electric arc furnace of the known type, for example, h' typically ranges from 900 mm to 1400 mm, whereas in the furnace according to the present invention, h' ranges from 1600 mm to 2200 mm. The inlet opening 17*a* is in any case confined in the development in height of the upper shell 12.

The upper shell 12 has a diameter coinciding with that of the lower shell 11 and a height which is such as to meet the conditions indicated above with respect to the height H of the whole vessel.

Finally, dmax being the maximum height or maximum distance of the roof 13 with respect to the upper shell 12 measured along the central axis of the vessel, dmax ranges from 0.9 m to 2 m. This allows possible jets released from the metal bath to be reduced, in particular when the furnace 10 is used in convertor mode.

The roof 13 is of the totally removable type and, as already specified above, comprises a passage opening 18 for the passage of at least one electrode E when the furnace 10 is used as an electric arc furnace.

In this case, a completion element 19, (roof "delta" or "delta" made of a refractory material) is advantageously removably coupled with the passage opening 18; said completion element 19 comprises one or more pass-through holes 19*a* for the passage of a corresponding electrode E.

A closing body 23 is also provided, which is removably associated with the roof 13 or with the completion element 19 for closing the passage opening 18 (in this case, the closing body forms a roof "delta") or the pass-through holes 19*a*, respectively. The furnace 10 can also be configured as an electric arc furnace or as a converter: in the former case, the passage opening 18 of the roof 13 is coupled with the completion element 19, (refractory roof "delta") for the insertion, through the same, of at least one electrode E, in the latter case, the passage opening 18 is closed by the closing body 23.

The closing body 23 is of the cooled type.

The roof 13 also comprises one or more charge openings 20 for feeding charge material in the solid state. In particular, the charge openings 20 are removably coupled with a second feeding group 102*b* for the continuous feeding of the charge material in the solid state, such as, for example, DRI (represented only in FIG. 1). These charge openings 20 are preferably of the closable type by means of a respective closing element advantageously of the removable type.

The evacuation opening 21 for evacuating fumes/gases that are generated during the production process, can be coupled with an extraction module 105 (suction) for the extraction of the fumes (represented only in FIGS. 1 and 2). If the furnace 10 is used in the converter mode, the evacuation opening 21 is generally coupled with the fume extraction module (suction). If, on the other hand, the furnace 10 is used as an electric arc furnace in continuous, the evacuation opening 21 is generally closed by a respective closing element advantageously of the removable type; the fumes generated inside the furnace 10 are discharged through the first continuous feeding group 102*a* of the charge material in the solid state (of the type Consteel® of the known systems) which is connected to the first inlet opening 17*a* for preheating the charge material itself.

The evacuation opening 21 is dimensioned in relation to the suction rate of the fumes to be obtained and which, when the furnace 10 is used in the converter mode, must be limited in order to prevent the powders or other materials from being entrained with the fumes, possibly blocking the extraction module and/or subsequent treatment systems of the fumes extracted.

Also in this case, all of the openings obtained in the roof 13 (except for the evacuation opening 21), and also the connection between the roof 13 and the upper shell 12, can be substantially hermetically closed in order to prevent the entry of atmospheric air into the furnace 10 and the exit of gases from the furnace, that are generated in its inside. This is advantageously the case when the charge material totally or prevalently consists of cast iron in the molten state (liquid cast iron) and the furnace 10 is used in the converter mode; in this case, in fact, in some of the implementation phases of the production processes, gases rich in carbon monoxide (CO) are generated, that can be recovered and re-used also inside the same steelworks as fuel, for example.

The furnace 10 also comprises an injection group comprising at least three (3) injectors 22 for the injection of process fluids or powders into the same furnace 10.

In a preferred embodiment, the injectors 22 are positioned in correspondence of the upper shell 12; the possibility is not excluded, however, that the injectors 22 be positioned in correspondence of the roof 13, the horizontal panel of the EBT chamber or along the first feeding group 102*a* for the continuous feeding of charge material in the solid state through the first inlet opening 17*a* of the upper shell 12. The injectors 22 are particularly conceived for injecting oxygen ($O_2$) and/or materials in the powder form or granules such as, for example: lime, dolo lime, coal or other materials necessary for the formation and control of slag.

If the injectors 22 are provided for the injection of oxygen, they can be provided for the injection of:

- supersonic oxygen for the decarburization process with shrouding flame of the main jet,
- oxygen necessary for the post-combustion process and, in this case, the injectors 22 are advantageously positioned in the roof 13 so as to be facing the first inlet opening 17*a* obtained in the upper shell 12 and with which the first feeding group of charge material in the solid state (such as Consteel®), is coupled,
- oxygen for the decarburization process beneath the surface of the metal bath.

An object of the present invention also relates to a metallurgical plant 100 comprising a furnace 10 as described above, i.e. the plant 100 can be flexibly configured and adapted to different conditions and production requirements that can vary with time in relation to the availability of electric energy and/or the type of raw materials available.

The plant 100 is of the modular type for conducting production processes for the production of molten metal, in particular steel or cast iron, and in particular for conducting production processes in which the charging of any mixture of raw materials or charge material into the furnace 10 and melting of the same inside the furnace 10 take place in a continuous and controlled manner.

The term raw materials refers to both charge materials in the solid state, and charge materials in the molten or liquid state and also to process materials of the known type and variable in relation to the production process carried out.

For the production of steel or cast iron, in particular, for charge material in the molten state, the cast iron is in the molten state (liquid cast iron), whereas charge material in the solid state refers to scrap, DRI (direct reduced iron), HDRI (hot direct reduced iron), pig iron and HBI (hot briquetted iron), wherein the charge materials in the liquid state and in the solid state can be used alone or in a mixture of two or more of each other.

Process materials such as oxygen, coal, methane, lime, dolo lime, alloying materials and others known to skilled persons in the field, are added to these charge materials.

The charge materials are preferably fed in continuous, by way of example and not limited, with the following methods: continuous feeding with or without preheating of the charge material in the solid state, by means of a lateral inertial conveyor (e.g. Consteel®) or through the roof 13 (for scrap, pig iron HBI); continuous feeding by means of conveyor belts or conveyors, through the roof 13 (for DRI and Hot DRI); continuous feeding by means of a ladle and adduction to the furnace by means of a lateral channel or through the slag door of the furnace (for liquid cast iron or other liquid material).

A batch-type feeding, of the type with baskets, is also possible, through the top of the vessel with the roof 13 completely open, particularly in the case of solid charge material.

Depending on the charge material and metal to be produced, the energy supply necessary for the production process can be of the electric and/or chemical type.

Electric energy developing heat is supplied by means of one or more electrodes and the chemical energy developing and sustaining the reactions is supplied by means of oxygen and possible fuels (gaseous or pulverized) that are injected into the metal bath.

The plant 100 comprises a furnace 10 and at least one operating module selected from the group comprising:

- a power supply module of electric energy 101 for supplying electric energy to the metal bath and comprising at least one electrode E removably insertable in the vessel through the passage opening 18 obtained in the roof 13,
- a feeding module of charge material in the solid state 102 for the continuous feeding of charge material in the solid state into the furnace 10 and in turn comprising at least one feeding group for feeding in continuous charge material in the solid state selected from:
- a first feeding group 102*a* for the continuous feeding of the charge material in the solid state that can be removably associated with the first inlet opening 17*a* obtained in the upper shell 12 for the continuous feeding, through the same, of charge material in the solid state,
- a second feeding group 102*b* (not illustrated in detail as it is of the type known to skilled persons in the field) for the continuous feeding of the charge material in the solid state that can be removably associated with the charge opening 20 obtained in the upper roof 13 for the feeding, through the same, of charge material in the solid state,
- a feeding module of charge material in the molten state 103 for the feeding, preferably in continuous, of charge material in the molten state into the furnace 10 and comprising a feeding group 103*a* for the feeding, preferably in continuous, of material in the molten state that can be removably associated with the second inlet opening 17*b* obtained in the upper shell 12 for the feeding, through the same, of charge material in the molten state,
- a feeding module of charge material in the molten state, of the type, for example, with baskets, and not illustrated as it is of the known type, for the batch feeding of charge material in the solid state into the furnace 10 through the top of the vessel (i.e. with the roof 13 open),
- an extraction module of the fumes 105 which are generated inside the furnace 10 during the production process of the molten metal and that can be removably associated with the evacuation opening 21 obtained in the roof 13, also in this case, the fume extraction module is not illustrated in detail as it is of the type known to skilled persons in the field.

The power supply module of electric energy 101 for the supply of electric energy to the metal bath comprises at least one electrode E removably insertable in the vessel through the passage opening 18 obtained in the roof 13 through the completion element 19 (roof "delta") coupled with the same.

The electric energy, that can be of the DC or AC type, is transferred by means of an electric arc, and is conducted through electrodes E made of graphite or equivalent materials.

The module 101 comprises in particular arms 110 that support the electrodes E, said arms 110 being configured, in the known way, for conducting current to the same electrodes, and also for extracting the electrodes E from the roof 13, by lifting and rotating them or moving them in another position, and also for regulating their position in relation to wear, also with automatic methods ("auto slipping").

The first feeding group 102*a* for the continuous feeding of charge material in the solid state and which can be removably associated with the first inlet opening 17*a* obtained in the upper shell 12 for the continuous feeding, through the same, of charge material in the solid state, advantageously, but not exclusively, consists of a known "Consteel®" system which feeds charge material (scrap, DRI, pig iron, etc.) in continuous, preheating it with the heat of the fumes leaving the furnace 10.

Said "Consteel®" system is described, for example, in U.S. Pat. Nos. 4,543,124, 5,800,591, PCT/EP2013/001941 and consists of a continuous conveyor of the charge material along which a charging area 120, in correspondence with which the charge material is deposited on the conveyor, and a preheating area 122 of the charge material, in correspondence with which the charge material is preheated by the heat of the fumes developed in the furnace 10, are defined in sequence, starting from the furthest end towards the closest end with respect to the furnace 10.

In correspondence with the preheating area 122, the conveyor is housed in a tunnel 124 that has one end connected to the first inlet opening 17*a* and the opposite end provided with a suction device of the fumes 121 upstream of which a sealing device 123, configured for limiting the entry of atmospheric air into the tunnel 124, is positioned. The fumes generated in the furnace 10 are sucked along the tunnel 124 and while passing through the same, they transfer heat to the charge material which is thus preheated.

In this case, the evacuation opening 21 of the roof 13 is closed by a respective closing element or in any case sealed.

The first feeding group 102*a* is provided for feeding charge material in the solid state into the furnace 10, comprising scrap, DRI, solid cast iron, alone or mixed with one another.

If the charge material in the solid state does not form the mixture of process raw materials or is introduced into the same only through the roof 13, the first feeding group 102*a* is absent and the first inlet opening 17*a* is closed by a respective closing element or in any case sealed.

The second feeding group 102*b* for the continuous feeding of charge material in the solid state and which can be removably associated with the charge opening 20 formed in the roof 13, comprises, for example, conveyor belts or conveyors that are installed above the roof 13 and positioned so that their discharging end communicates with the at least one charge opening 20.

The material in the solid state fed through the roof 13 generally comprises small-sized raw materials, such as, for example, ground scrap, DRI or HBI (at room temperature (DRI), if collected from a storage deposit, or at a high temperature (HDRI or HBI), if it comes directly from a production plant integrated in the plant 100 without intermediate storage), and/or deslagging additives (typically lime, dolo lime, etc.), fuel additives (coal), alloying materials.

The feeding group 103*a* for the feeding, preferably in continuous, of material in the molten state and which can be removably associated with the second inlet opening 17*b* obtained in the upper shell 12 for feeding, through the same, charge material in the molten state, consists of a dosing device for the controlled introduction of liquid cast iron or other molten materials into the furnace 10.

It comprises a supporting structure 130 on which a ladle 131 or other container containing the charge material in the molten state (generally cast iron) is positioned, and which is tilted so as to pour the charge material in the liquid state into a channel 132 whose discharge end is in communication with the second inlet opening 17*b* of the upper shell 12.

The tilting of the ladle 131 is controlled by means of suitable control systems in order to regulate the flow-rate of cast iron fed into the furnace 10. Said flow-rate can be kept at a constant value or it can follow a certain trend with time depending on the process requirements. The control systems can comprise, for example, hydraulic actuators 133 or of another type, controlled in relation to the signals revealed by detection devices for the direct or indirect detection of the weight or in any case the content of the ladle 131 such as, for example, load cells, optical measuring devices, gauges for measuring the pressure inside the hydraulic actuators, inclinometers, etc.

If the raw materials forming the charge of the furnace do not comprise charge material in the liquid state, the relative feeding module 103 and corresponding feeding group 103*a* are absent and the second opening 17*b* of the upper shell 12 is closed by a respective closing element of the removable type or in any case sealed.

As indicated above, a feeding module of charge material in the solid state can also be provided, which feeds charge material in the solid state batchwise into the furnace 10 through the roof 13 or in any case through the open top of the vessel. This module can comprise, for example, known basket-type charging groups.

It should be pointed out that all of the modules and relative feeding groups of charge material in the solid state or liquid state are controlled and piloted in relation to the process requirements.

If the plant 100 operates in the continuous mode, the feeding rate of the various charge materials can be regulated in relation to the process requirements, depending on the type or weight of the charge material: the feeding rate of the various materials generally follows a predefined time trend.

The extraction module 105 for the extraction of the fumes generated inside the furnace 10 during the production process of molten metal and which can be removably associated with the evacuation opening 21 formed in the roof 13, is of the known type and is therefore not described in detail.

Said extraction module 105 is present, in particular, when the fumes are not extracted through the first feeding group 102*a* for preheating the charge material in the solid state fed by the latter.

As already mentioned, if, in particular, the furnace 10 is used in the converter mode, it is possible to seal all of the openings (deslagging opening 15, tapping opening 16, first inlet opening 17*a*, second inlet opening 17*b*, charge opening 20 except for the evacuation opening 21) and/or their connection to the relative casting and slagging systems and modules or feeding groups, in order to at least partially recover the gases generated during some phases of the reduction process, rich in CO, that can be used as fuel (with a low calorific value) in other steelmaking processes.

The extraction module 105, moreover, can be conveniently equipped with thermal energy recovery systems of the gases leaving the furnace, for example for the production of vapour, which can take place with various systems, comprising, inter alia, "cooled tube" systems (ECS—Evaporative Cooling System) and heat exchangers (WHB—Waste Heat Boiler).

The thermal energy of the fumes extracted from the furnace 10 can also be recovered in chemical processes not strictly linked to steelmaking processes; the heat of said fumes, for example, can be recovered in chemical reactors for the cracking of hydrocarbons for the production of combustible fluids.

As already specified above, the plant 100 is of the modular type and can be flexibly configured for conducting production processes of steel or cast iron in the molten state in relation to the availability of electric energy and types of raw materials available.

The plant 100 can generally be set up in two main configurations.

In a first configuration, the plant 100 is set up so as to have a high short-term flexibility, i.e. so as to allow a variation in its arrangement from campaign to campaign (wherein each campaign comprises cycles of a few hundreds of castings, equivalent to a few weeks of operation). In this case, the upper shell 12 is dimensioned so as to make the furnace 10 suitable for operating as a converter (i.e. H ranging from 0.8 D to 1.25 D) and it is not substituted in the passage of the furnace 10 between the two main operating modes (i.e. EAF/Converter). With this dimensioning of the furnace and in particular the upper shell 12, also in the presence of particularly reactive processes (reduction of a charge prevalently composed of liquid cast iron, as when the furnace 10 is operating in the converter mode), the consequences of a possible development of high effervescence (projection of molten material against the roof 13 and in the mouth of the evacuation opening 21 of the fumes) can be avoided.

In a second configuration, the plant 100 is set up so as to have a high long-term flexibility, in the order of a few tens of campaigns. In this case, the furnace 10 and in particular the upper shell 12 is initially dimensioned for operating in the converter or EAF mode and is subsequently substituted or in any case modified when the operating mode is to be changed.

Typically, the furnace 10 is initially configured for prevalently operating as a converter and subsequently modified for prevalently operating as an EAF. This takes place, for example, when the plant 100 is installed in countries that have high integral-cycle productions of cast iron (in blast furnaces) and in which the steel scrap becomes available at competitive prices.

The plant 100 can therefore be adapted, in the short or long term, in relation to the availability of energy and raw materials, without revolutionizing the whole plant, but only adding or substituting the necessary modules.

Some possible configurations of the plant 100 are described hereunder.

The plant 100 can be configured for steel production starting from a mixture of raw materials constituted for the whole of the charge material in the solid state prevalently consisting of scrap with which DRI, HDRI, HBI and/or pig iron fed in continuous into the furnace 10, can be mixed.

In this case, therefore, the furnace 10 is configured for operating in the EAF mode and, advantageously, but not necessarily, the upper shell 12 is dimensioned so that the overall height H of the vessel ranges from 0.70 D to 0.80 D, wherein D is the diameter of the lower shell 11.

The passage opening 18 of the roof 13 is associated with the completion element 19 (refractory roof "delta") through whose pass-through holes respective electrodes E can be inserted.

The evacuation opening 21 of the roof 13 is closed and the charge opening 20 of the roof 13 is opened for feeding, through the same, charge material in the solid state such as DRI, ground scrap and/or alloying materials and/or additives.

The first inlet opening 17*a* of the upper shell 12 is opened for feeding, through the same, charge material in the solid state (scrap possibly mixed with DRI and/or pig iron), whereas the possible second inlet opening 17*b* for feeding charge material in the molten state, is closed.

The plant 100 therefore comprises the following active operating modules:

- the power supply module of electric energy 101,
- the feeding module of charge material in the solid state 102 for feeding in continuous charge material in the solid state into the furnace 10 and in turn comprising:
- the first feeding group 102*a*, advantageously of the type Consteel®, which is coupled with the first inlet opening 17*a* for feeding, through the same, charge material in the solid state (scrap possibly mixed with DRI and/or pig iron),
- the second feeding group 102*b*, for feeding in continuous, through the same, charge material in the solid state (DRI, ground scrap, alloying materials) and which is coupled with the charge opening 20 of the roof for feeding, through the same, charge material in the solid state.

In this configuration of the plant 100, the fumes generated inside the furnace 10 during the production process are evacuated through the first feeding group 102*a* for preheating the respective charge material in the solid state.

In this configuration of the plant 100, the feeding module of charge material in the liquid state 103 is absent or in any case not active.

The plant 100 thus configured is suitable for the production in continuous of steel starting from a mixture of raw materials in the solid state fed continuously to the furnace operating in the EAF mode.

In an alternative configuration embodiment, the plant 100 is configured for the production of steel starting from a mixture of raw materials in the solid state fed prevalently batchwise only through the roof 13 and the furnace 10 operates in the EAF mode. In this case:

- the vessel, advantageously, but not necessarily, has an overall height H ranging from 0.70 D to 0.80 D,
- the passage opening 18 of the roof 13 is associated with the completion element 19 (refractory roof "delta") through whose pass-through holes 19*a* respective electrodes E can be inserted,
- the evacuation opening 21 of the roof 13 is open and
- both of the inlet openings 17*a*, 17*b* of the upper shell 12 are closed.

The plant 100 comprises the following active operating modules:

- the power supply module of electric energy 101,
- at least the feeding module of charge material in the solid state for the batch feeding (for example with baskets) of charge material in the solid state (in particular scrap) into the furnace 10 through the top of the vessel with the roof 13 open, in addition to the second feeding group 102*b* for feeding charge material in the solid state (of the type DRI, alloying materials and the like) through the charge opening 20 of the roof 13,
- the extraction module of the fumes 105 generated inside the furnace 10 and which is associated with the evacuation opening 21 of the roof 13.

In this configuration of the plant 100, the charge material in the solid state comprises, for example, a mixture of DRI and scrap and solid pig iron and scrap possibly containing binders.

In this configuration of the plant 100, the feeding module of charge material in the liquid state 103 and the first feeding group 102*a* for the continuous feeding of charge material in the solid state, are absent or in any case not active.

The plant 100 thus configured is suitable for steel production starting from a mixture of raw materials in the solid state fed batchwise into the furnace operating in the EAF mode.

In a further possible alternative configuration, the plant 100 can be set up for producing steel starting from a mixture of raw materials composed of charge material in the solid state in a quantity equal to or higher than 25% and charge material in the liquid state in a quantity equal to or lower than 75%.

The charge material in the solid state prevalently consists of scrap which can be mixed with DRI and/or pig iron fed in continuous into the furnace 10.

The charge material in the liquid state is composed of liquid cast iron fed in continuous to the furnace.

In this case:

- the passage opening 18 of the roof 13 is open and associated with the completion element 19 (refractory roof "delta") for the passage through the same of at least one electrode,
- the evacuation opening 21 of the roof 13 is closed and the charge opening 20 of the roof 13 for feeding, through the same, charge material in the solid state, is open,
- the first inlet opening 17*a* of the upper shell 12 for feeding, through the same, charge material in the solid state, is open and the second inlet opening 17*b* of the upper shell 12 for feeding, through the same, charge material in the molten state, is open.

The plant 100 comprises the following active operating modules:

- the power supply module of electric energy 101,
- the feeding module of charge material in the solid state and in turn comprising:
- a first feeding group 102*a* of the type Consteel® which is associated with the first inlet opening 17*a* for feeding, through the same, charge material in the solid state,
- a second feeding group 102*b* which is associated with the charge opening 20 for feeding, through the same, charge material in the solid state,
- the feeding module of charge material in the molten state 103 whose feeding group 103*a* is associated with the second inlet opening 17*b* for feeding, through the same, charge material in the molten state.

The fumes generated inside the furnace during the production process of said molten metal are evacuated through the first feeding group 102*a* for preheating the respective charge material in the solid state.

FIG. 7 shows a plant 100 configured as described above for the production of steel starting from a mixture of raw materials composed for about 90% of charge material in the solid state and for 10% of charge material in the liquid state.

FIG. 8 shows a variant of the plant 100 of FIG. 7 configured for the production of steel starting from a mixture of raw materials composed for about 50% of charge material in the solid state and for 50% of charge material in the liquid state.

This variant differs from that shown in FIG. 7 in the length of the first feeding group 102*a* (Consteel®).

In a further possible alternative configuration, the plant 100 can be set up for producing steel starting from a mixture of raw materials composed of charge material in the solid state, fed batchwise only through the roof 13, in a quantity equal to or higher than 25% and charge material in the liquid state in a quantity equal to or lower than 75%.

The charge material in the solid state prevalently consists of scrap, which can be mixed with DRI and/or pig iron which however are fed in continuous to the furnace 10.

The charge material in the liquid state is composed of liquid cast iron fed in continuous to the furnace.

In this case:

- the passage opening 18 of the roof 13 is open and associated with the completion element 19 (refractory roof "delta") for the passage through the same of at least one electrode,
- the evacuation opening 21 of the roof 13 is open and the charge opening 20 of the roof 13 for feeding, through the same, charge material in the solid state, is open,
- the first inlet opening 17*a* of the upper shell 12 for feeding, through the same, charge material in the solid state, is closed and the second inlet opening 17*b* of the upper shell 12 for feeding, through the same, charge material in the molten state, is open.

The plant 100 comprises the following active operating modules:

- the power supply module of electric energy 101,
- at least the feeding module of charge material in the solid state for the batch feeding (for example with baskets) of charge material in the solid state (in particular scrap) into the furnace 10 through the top of the vessel with the roof 13 open, in addition to the second feeding group 102*b* for feeding charge material in the solid state (of the type DRI and the like) through the charge opening 20 of the roof 13,
- the extraction module of the fumes 105 generated inside the furnace 10 and which is associated with the evacuation opening 21 of the roof 13,
- the feeding module of charge material in the molten state 103 whose feeding group 103*a* is associated with the second inlet opening 17*b* for feeding, through the same, charge material in the molten state.

In this configuration of the plant 100, the charge material in the solid state comprises, for example, a mixture of DRI and scrap or solid pig iron and scrap possibly containing binders.

In this configuration, the first feeding group 102*a* for the continuous feeding of charge material in the solid state is absent or in any case not active.

The fumes generated inside the furnace during the production process of said molten metal are evacuated through the evacuation opening 21 of the roof 13 and the fume extraction module 105 associated therewith.

In a further possible configuration, the plant 100 is configured for the production of cast iron starting from charge material in the solid state consisting of DRI with a Carbon content ≥5%.

In this case:

- the vessel, advantageously, but not necessarily, has an overall height H ranging from 0.70 D to 0.80 D,
- the passage opening 18 of the roof 13 is open and associated with the completion element 19 (refractory roof "delta") for the passage through the same of at least one electrode E,
- the evacuation opening 21 of the roof 13 is open,
- the charge opening 20 of the roof 13 is open for feeding, through the same, charge material in the solid state,
- the inlet openings 17*a*, 17*b* of the upper shell 12 are closed or in any case absent.

In this configuration, the plant 100 comprises the following active operating modules:

- the power supply module of electric energy 101,
- a feeding module of charge material in the solid state for feeding charge material in the solid state into the furnace through the roof and/or through the charge opening 20 of the roof 13, said module comprising in particular at least the second feeding group 102*b* for feeding charge material in the solid state through the charge opening 20 of the roof 13,
- the extraction module of the fumes 105 which is associated with the evacuation opening 21.

The first feeding group 102*a* for the continuous feeding of charge material in the solid state and the module for feeding of charge material in the liquid state 103 are absent or in any case inactive.

In a further possible configuration, the plant 100 is configured for the production of steel starting from a mixture of raw materials composed of charge material in the solid state in a quantity equal to or lower than 25% and charge material in the liquid state in a quantity equal to or higher than 75%.

The charge material in the solid state comprises DRI, HDRI, HBI, solid pig iron and scrap alone or in a mixture with one another in a percentage equal to or lower than 25% of the total charge material and is fed in continuous to the furnace 10.

The charge material in the liquid state consists of liquid cast iron fed to the furnace preferably and substantially in continuous.

In this case:

- the vessel, advantageously, but not necessarily, has an overall height H ranging from 0.80 D to 1.25 D,
- the passage opening 18 of the roof 13 is closed,
- the evacuation opening 21 of the roof 13 is closed,
- the charge opening 20 of the roof 13 is open for feeding, through the same, charge material in the solid state,
- the first inlet opening 17*a* of the upper shell 12 is open for the continuous feeding, through the same, of charge material in the solid state and
- the second inlet opening 17*b* of the upper shell 12 is open for the continuous feeding, through the same, of charge material in the molten state.

In this configuration, the plant 100 comprises the following active operating modules:

- the feeding module of charge material in the solid state 102 and in turn comprising:

a first feeding group 102*a* of the Consteel® type which is associated with the first inlet opening 17*a* for feeding, through the same, charge material in the solid state, the second feeding group 102*b* which is associated with the charge opening 20 of the roof 13 for feeding, through the same, charge material in the solid state, the feeding module of charge material in the molten state 103 comprising the feeding group 103*a* which is associated with the second inlet opening 17*b* for feeding, through the same, charge material in the molten state.

The fumes generated inside the furnace are evacuated through the first feeding group 102*a* for preheating the respective charge material in the solid state.

In this case, due to the high percentage of liquid cast iron, the power supply module of electric energy 101 is absent or in any case inactive.

A possible configuration of this kind is shown in FIG. 9.

In a further possible alternative configuration, the plant 100 is configured for the production of steel starting from a mixture of raw materials consisting of charge material in the solid state in a quantity equal to or lower than 25% and charge material in the liquid state in a quantity equal to or higher than 75%, wherein the charge material in the solid state is fed exclusively through the roof of the furnace.

With respect to the configuration described above with reference to FIG. 9, in this case, the first inlet opening 17*a* is closed and the first feeding group 102*a* is absent or in any case not active, the fumes being evacuated through the evacuation opening 21 of the roof associated with the extraction module 105.

In all of the embodiments described above, the injection group, the injectors 22 of which inject oxygen and other gaseous or powder raw materials (lime, carbon, dolo lime, etc.) into the furnace 10, is active.

In practice, it has been found that the furnace and plant according to the present invention have achieved the intended objectives.

The furnace and plant thus conceived can undergo numerous modifications and variants, all within the scope of the invention, furthermore, all the details can be substituted by technically equivalent elements.

In practice, the materials used, as also the dimensions, can vary according to technical requirements.

The invention claimed is:

1. A metallurgical furnace of the convertible type to an electric arc furnace or to a converter for conducting production processes for the production of metals in the molten state, in particular steel or cast iron, wherein it comprises:

a vessel comprising:

a lower shell for containing the metal bath, said metal bath being composed of molten metal and an overlying layer of slag, wherein said lower shell is tiltingly supported and is provided with a deslagging opening for evacuating the slag overlying the molten metal and with a tapping opening for tapping the molten metal, an upper shell removably positioned on said lower shell and provided with a first inlet opening for feeding, through the same, charge material in the solid state and configured to be associated with a first feeding group for the continuous feeding of said charge material in the solid state and/or a second inlet opening for feeding, through the same, charge material in the molten state and configured to be associated with a feeding group for the continuous feeding of said charge material in the molten state, a closing roof for the upper closing of said vessel, wherein said closing roof is removably positioned above said upper shell and is provided with a passage opening for the passage, through the same, of at least one electrode, at least one charge opening for feeding, through the same, charge material in the solid state, and at least one evacuation opening for discharging the gas fumes generated inside said furnace during the production process, wherein at least one of said first inlet opening, said second inlet openings, said passage opening, said charge opening and said evacuation opening is closed or can be associated with a closing element of the removable type, wherein said lower shell has a diameter D and said vessel has an overall height H ranging from 0.70 D to 1.25 D, said furnace being equipped with a group of injectors for the injection of oxygen and other gaseous or powder raw materials into said furnace, wherein said injectors are inserted in said upper shell at the lateral wall thereof.

2. The metallurgical furnace according to claim 1, wherein, S being the extension in $m^2$ of the free surface of said metal bath, it meets the condition according to which, R being the ratio between the flow-rate, expressed as $m^3$/min of carbon monoxide generated during the decarburization of the metal bath for the production of steel or cast iron and said extension S, said ratio $R(P_{CO}/S)$ is $\geq 16$.

3. The metallurgical furnace according to claim 1, wherein, Lbmax being the maximum level that can be reached by the metal bath contained in said lower shell, the vertical distance h between Lbmax and the lower edge of said deslagging opening ranges from 0.055 D to 0.077 D.

4. The metallurgical furnace according to claim 1, wherein Lbmax being the maximum level that can be reached by the metal bath contained in said lower shell, the vertical distance h' between Lbmax and the lower edge of said at least one inlet opening ranges from 1.6 m to 2.2 m, wherein said inlet opening is provided for the entry, through the same, of charge material in the solid state.

5. The metallurgical furnace according to claim 1, wherein the maximum height dmax of said roof with respect to said upper shell ranges from 0.9 m to 2 m.

6. The metallurgical furnace according to claim 1, wherein it comprises a completion element of said closing roof which can be removably associated with said passage opening for the passage, through the same, of at least one electrode, wherein said completion element comprises at least one pass-through hole for the passage, through the same, of at least one electrode.

7. The metallurgical furnace according to claim 6, wherein it comprises a closing body removably associated with said closing roof or said completion element for closing said passage opening or said at least one pass-through hole, respectively.

8. The metallurgical furnace according to claim 1, wherein said injection group comprises at least three injectors.

9. A modular metallurgical plant for conducting production processes of molten metal, in particular steel or cast iron, comprising a metallurgical furnace according to claim 1 and at least one operating module selected from the group comprising:

a power supply module of electric energy for supplying electric energy to said metal bath and comprising at least one electrode removably insertable into said vessel through said passage opening of said closing roof, a feeding module for feeding charge material in the solid state for the continuous feeding of charge material in the solid state into said furnace and, in turn, comprising at least one feeding group of charge material in the solid state selected from a first feeding group for the continuous feeding of said charge material in the solid state which can be removably associated with said first inlet opening formed in said upper shell for feeding, through the same, charge material in the solid state, a second feeding group for the continuous feeding of said charge material in the solid state which can be removably associated with said at least one charge opening obtained in said closing roof for feeding, through the same, charge material in the solid state, a feeding group of charge material in the molten state for the feeding of charge material in the molten state into said furnace and comprising a feeding group for feeding material in the molten state, which can be removably associated with said second inlet opening obtained in said upper shell for feeding, through the same, charge material in the molten state, a feeding module of charge material in the solid state for the batch feeding of charge material in the solid state into said furnace through said at least one charge opening obtained in said closing roof, an extraction module of fumes for the extraction of fumes generated inside said furnace during the production process of said molten metal and which can be removably associated with said evacuation opening obtained in said closing roof.

10. The metallurgical furnace according to claim 9, configured for the production of steel or cast iron, wherein said charge material in the molten state is cast iron in the molten state and wherein said charge material in the solid state comprises scrap, DRI (direct reduced iron), HDRI (hot direct reduced iron), pig iron and HBI (hot briquetted iron), alone or in a mixture with two or more of each other, wherein the charge material fed to said furnace comprises charge material in the molten state and/or charge material in the solid state, alone or mixed with each other.

11. The metallurgical plant according to claim 10 for the production of steel starting from charge material in the solid state only, wherein:

the closing roof of said metallurgical furnace has said passage opening open and associated with a completion element comprising at least one pass-through hole for the passage through the same of at least one electrode, said evacuation opening closed and said at least one charge opening for feeding, through the same, charge material in the solid state, open, said upper shell has a first inlet opening for feeding, through the same, charge material in the solid state, open, and a possible second inlet opening for feeding, through the same, charge material in the molten state, closed, and wherein said metallurgical plant comprises the following active operating modules:

a power supply module of electric energy to said metal bath and comprising at least one electrode which can be removably inserted into said vessel through said pass-through hole of said completion element, a feeding module of charge material in the solid state for the continuous feeding of charge material in the solid state into said furnace, in turn comprising:

a first feeding group for the continuous feeding of said charge material in the solid state associated with said first inlet opening obtained in said upper shell for feeding, through the same, charge material in the solid state, wherein said charge material in the solid state is scrap or a mixture of scrap and solid pig iron, a second feeding group for the continuous feeding of said charge material in the solid state associated with said at least one charge opening obtained in said roof for feeding, through the same, charge material in the solid state, wherein said charge material in the solid state is DRI or solid cast iron or binders, alone or mixed with each other, wherein the fumes generated inside said furnace during the production process are evacuated through said first feeding group for preheating the respective charge material in the solid state.

12. The metallurgical plant according to claim 10 for the production of steel starting from charge material in the solid state only, wherein:

the closing roof of said metallurgical furnace has said passage opening open and associated with a completion element comprising at least one pass-through hole for the passage, through the same, of at least one electrode, said evacuation opening open and said at least one charge opening for feeding, through the same, charge material in the solid state, open, said upper shell has said first inlet opening and said second inlet opening for feeding, through the same, charge material in the solid state or in the molten state, closed, and wherein said metallurgical plant comprises the following active operating modules:

a power supply module of electric energy to said metal bath and comprising at least one electrode which can be removably inserted in said vessel through said pass-through hole of said completion element, at least one feeding module of charge material in the solid state for the batch feeding of charge material in the solid state into said furnace through said at least one charge opening obtained in said closing roof and/or through the top of said vessel with the closing roof open, an extraction module of fumes for the extraction of fumes generated inside said furnace during the production process of said molten metal and associated with said evacuation opening obtained in said closing roof, wherein said charge material in the solid state comprises a mixture of DRI and scrap or solid pig iron and scrap.

13. The metallurgical plant according to claim 10 for the production of cast iron starting from charge material in the solid state only, wherein:

the closing roof of said metallurgical furnace has said passage opening open for the passage, through the same, of at least one electrode, said evacuation opening open and said at least one charge opening for feeding, through the same, charge material in the solid state, open, said upper shell has said first inlet opening and said second inlet opening for feeding, through the same, charge material in the solid state, or in the molten state, closed, and wherein said metallurgical plant comprises the following operating modules:

a power supply module of electric energy to said metal bath and comprising at least one electrode which can be removably inserted into said vessel through said passage opening of said closing roof, a feeding module of charge material in the solid state for feeding charge material in the solid state into said furnace through said at least one charge opening obtained in said closing roof and/or through the top of said vessel with the closing roof open, an extraction module of fumes for the extraction of fumes generated inside said furnace during the production process of said molten metal and associated with said evacuation opening obtained in said closing roof, wherein said charge material in the solid state consists of DRI with a Carbon percentage higher than or equal to 5% mixed with possible binders.

14. The metallurgical plant according to claim 10 for the production of steel starting from charge material in the solid state and in the liquid state, wherein:

the closing roof of said metallurgical furnace has said passage opening for the passage, through the same, of at least one electrode, closed, said evacuation opening closed and said at least one charge opening for feeding, through the same, charge material in the solid state, open, said upper shell has said first inlet opening for feeding, through the same, charge material in the solid state, open, and said second inlet opening for feeding, through the same, charge material in the molten state, open, and wherein said metallurgical plant comprises the following active operating modules:

a feeding module of charge material in the solid state for the continuous feeding of charge material in the solid state into said furnace and, in turn, comprising:

a first feeding group for the continuous feeding of said charge material in the solid state associated with said first inlet opening obtained in said upper shell for feeding, through the same, charge material in the solid state, a second feeding group for the continuous feeding of said charge material in the solid state associated with said at least one charge opening obtained in said closing roof for the feeding, through the same, of charge material in the solid state, wherein said charge material in the solid state comprises DRI, HDRI, HBI, solid pig iron and scrap alone or mixed with each other in a percentage equal to or lower than 25% of the total charge material, and wherein the fumes generated inside said furnace during the production process of said molten metal are evacuated through said first feeding group for preheating the respective charge material in the solid state, a feeding module of charge material in the molten state for feeding charge material in the molten state inside said furnace and comprising a feeding group for feeding material in the molten state associated with said second inlet opening obtained in said upper shell for feeding, through the same, charge material in the molten state, consisting of molten cast iron in a percentage equal to or higher than 75% of the total charge material.

15. The metallurgical plant according to claim 10 for the production of steel starting from charge material in the solid state and in the liquid state, wherein:

the closing roof of said metallurgical furnace has said passage opening for the passage, through the same, of at least one electrode, closed, said evacuation opening open, and said at least one charge opening for feeding, through the same, charge material in the solid state, open, said upper shell has said second inlet opening for feeding, through the same, charge material in the molten state, open, a-said possible first inlet opening for feeding, through the same, charge material in the solid state, being closed, and wherein said metallurgical plant comprises the following active operating modules:

at least one feeding module of charge material in the solid state for the batch feeding of charge material in the solid state into said furnace through said at least one charge opening obtained in said closing roof and/or through the top of said vessel with said closing roof open, wherein said charge material in the solid state comprises DRI, HDRI, HBI, solid pig iron and scrap alone or mixed with each other in a percentage equal to or lower than 25% of the total charge material, and a feeding module of charge material in the molten state for feeding charge material in the molten state into said furnace and comprising a feeding group for feeding material in the molten state associated with said second inlet opening obtained in said upper shell for feeding, through the same, charge material in the molten state, said charge material in the molten state being composed of molten cast iron in a percentage equal to or higher than 75% of the total charge material.

16. The metallurgical plant according to claim 10 for the production of steel starting from charge material in the solid state and in the liquid state, wherein:

the closing roof of said metallurgical furnace has said passage opening for the passage, through the same, of at least one electrode, open, said evacuation opening closed, and said at least one charge opening for feeding, through the same, charge material in the solid state, open, said upper shell has said first inlet opening for feeding, through the same, charge material in the solid state, open, and said second inlet opening for feeding, through the same, charge material in the molten state, open, and wherein said metallurgical plant comprises the following active operating modules:

a power supply of electric energy to said metal bath and comprising at least one electrode that can be removably inserted into said vessel through said passage opening of said closing roof, a feeding module of charge material in the solid state for the continuous feeding of charge material in the solid state into said furnace and in turn comprising:

a first feeding group for the continuous feeding of said charge material in the solid state removably associated with said first inlet opening obtained in said upper shell for feeding, through the same, charge material in the solid state, a second feeding group for the continuous feeding of said charge material in the solid state removably associated with said at least one charge opening obtained in said closing roof for the feeding, through the same, of charge material in the solid state, wherein said charge material in the solid state comprises DRI, HDRI, HBI, solid pig iron and scrap alone or mixed with each other in a percentage equal to or higher than 25% of the total charge material, and wherein the fumes generated inside said furnace during the production process of said molten metal are evacuated through said first feeding group for preheating the respective charge material in the solid state, a feeding module of charge material in the molten state for feeding charge material in the molten state into said furnace and comprising a feeding group for feeding material in the molten state associated with said second inlet opening obtained in said upper shell for feeding, through the same, charge material in the molten state, consisting of molten cast iron in a percentage equal to or lower than 75% of the total charge material.

17. The metallurgical plant according to claim 10 for the production of steel starting from charge material in the solid state and in the liquid state, wherein:

the closing roof of said metallurgical furnace has said passage opening for the passage, through the same, of at least one electrode, open, said evacuation opening open, and said at least one charge opening for feeding, through the same, charge material in the solid state, open, said upper shell has said second inlet opening for feeding, through the same, charge material in the molten state, open, said possible first inlet opening for feeding, through the same, charge material in the solid state, being closed, and wherein said metallurgical plant comprises the following active operating modules:

a power supply of electric energy to said metal bath and comprising at least one electrode that can be removably inserted into said vessel through said passage opening of said closing roof, a feeding module of charge material in the solid state for the batch feeding of charge material in the solid state into said furnace through said at least one charge opening obtained in said roof and/or through the top of said vessel with said closing roof open, wherein said charge material in the solid state comprises DRI, HDRI, HBI, solid pig iron and scrap alone or mixed with each other in a percentage equal to or higher than 25% of the total charge material, and a feeding module of charge material in the molten state for feeding charge material in the molten state into said furnace and comprising a feeding group for feeding material in the molten state associated with said second inlet opening obtained in said upper shell for feeding, through the same, charge material in the molten state, said charge material in the molten state consisting of molten cast iron in a percentage equal to or lower than 75% of the total charge material.

18. The metallurgical furnace according to claim 1, wherein said lower shell has a diameter D and said vessel has an overall height H ranging from 0.70 D to 0.80 D if the furnace is used as an electric arc furnace.

19. The metallurgical furnace according to claim 1, wherein said lower shell has a diameter D and said vessel has an overall height H ranging from 0.80 D to 1.25 D if the furnace is used as a converter.

* * * * *